US005575475A

United States Patent [19]

Steinbach

[11] Patent Number: 5,575,475

[45] Date of Patent: Nov. 19, 1996

[54] CARD SHUFFLER APPARATUS

[76] Inventor: James R. Steinbach, 9776 Orangewood Dr., Denver, Colo. 80221

[21] Appl. No.: 405,952

[22] Filed: Mar. 17, 1995

Related U.S. Application Data

[63] Continuation-in-part of Ser. No. 215,933, Mar. 22, 1994, Pat. No. 5,445,377.

[51] Int. Cl.[6] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 1,846,063 | 2/1932 | Matthaey | 273/149 R |
| 2,661,215 | 12/1953 | Stevens | 273/149 R |
| 4,513,969 | 4/1985 | Samsel, Jr. | 273/149 R |
| 5,445,377 | 8/1995 | Steinbach | 273/149 R |

OTHER PUBLICATIONS

Advertising Circular, Shuffle Master Inc., Double Deck Shufflers. (On file in Parent Case).

Advertising Circular, Shuffle Master Inc., Single Deck Shufflers. (On file in Parent Case).

Advertising Circular, Shuffle Master Inc., Poker Shuffler. (On file in Parent Case).

*Primary Examiner*—Benjamin H. Layno

*Attorney, Agent, or Firm*—Carl Schaukowitch

[57] ABSTRACT

A card shuffler apparatus operative to combine a plurality of stacks of unshuffled cards into a single stack of shuffled cards. The card shuffler apparatus includes a card feeder compartment, a card receiver compartment, a deflector structure and a card ejector mechanism. The card ejector mechanism is operative to eject at least a single card in each stack of unshuffled cards disposed in the card feeder compartment into the deflector structure. Ejected ones of the cards mix in the card deflector structure and deflect into the card receiver compartment thereby forming the single stack of shuffled cards. Also, a method for combining a plurality of stacks of unshuffled cards into a single stack of shuffled cards is described.

7 Claims, 14 Drawing Sheets

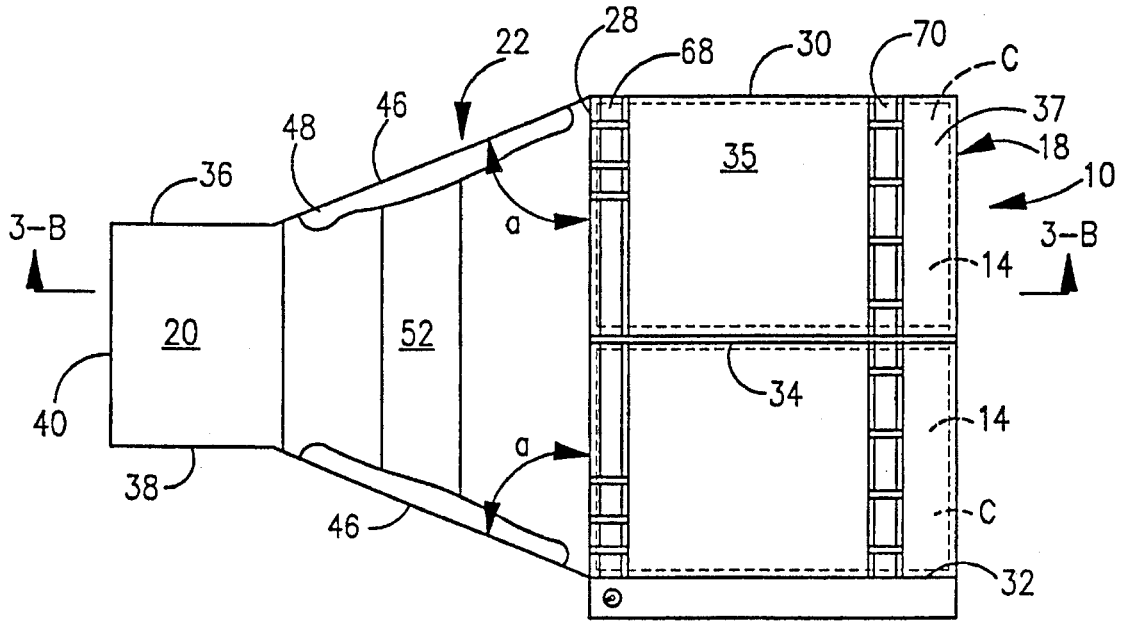
FIG. 3-A
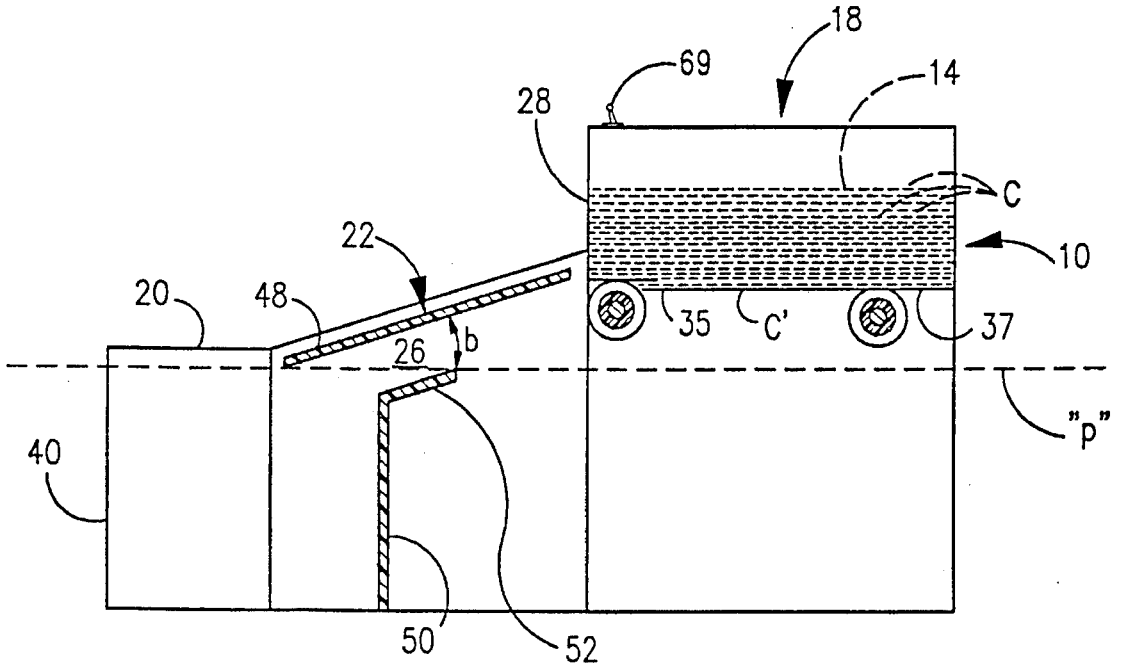
FIG. 3-B

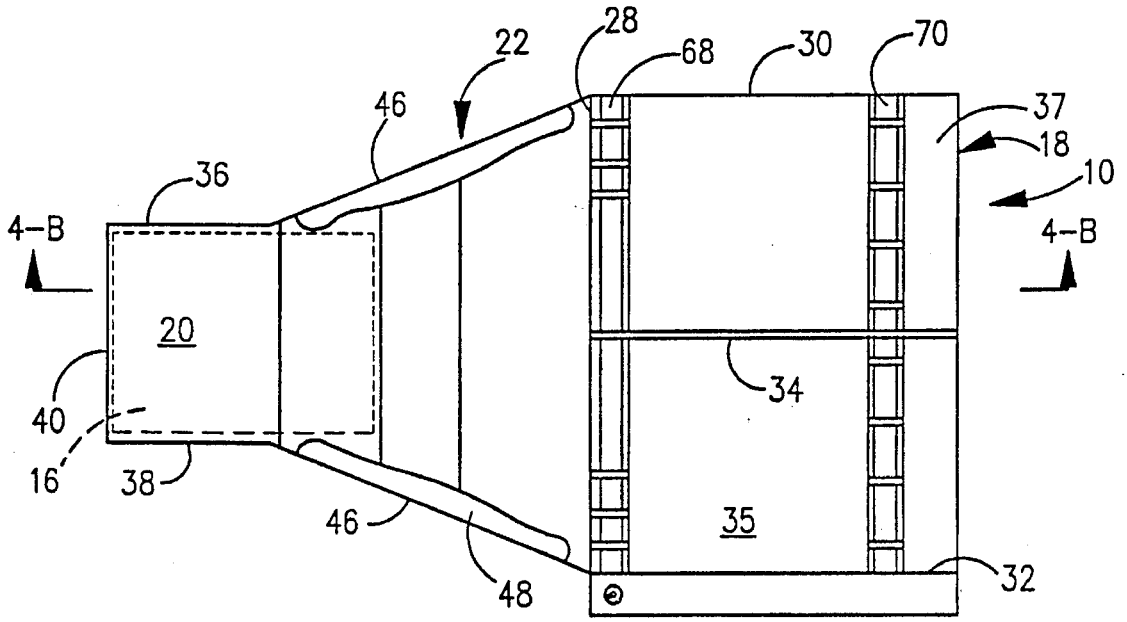
FIG. 4-A
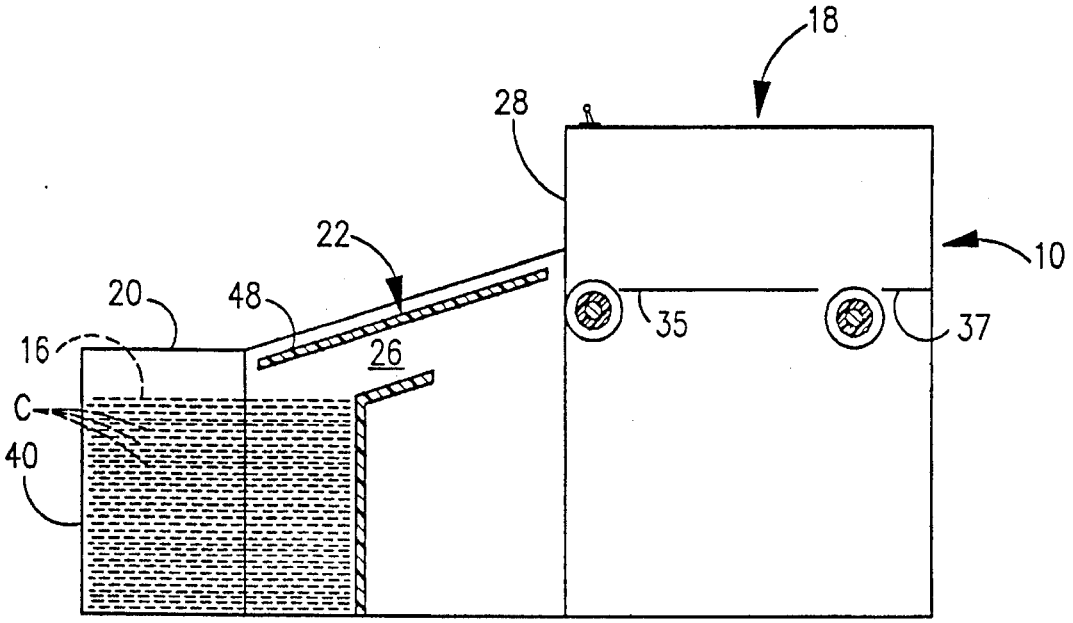
FIG. 4-B

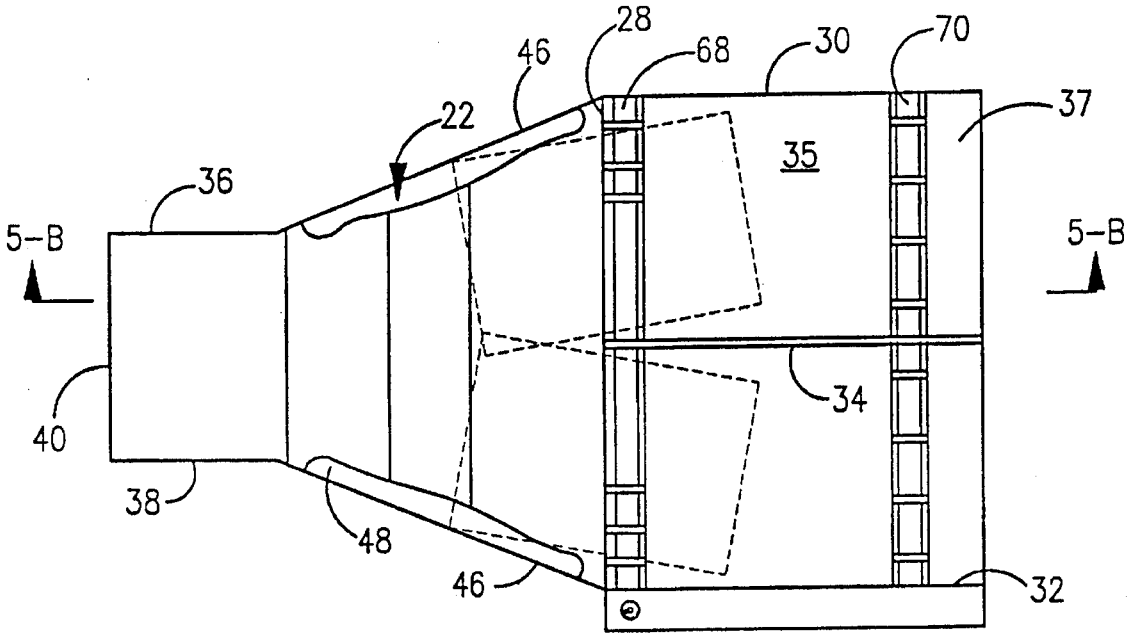
FIG. 5-A
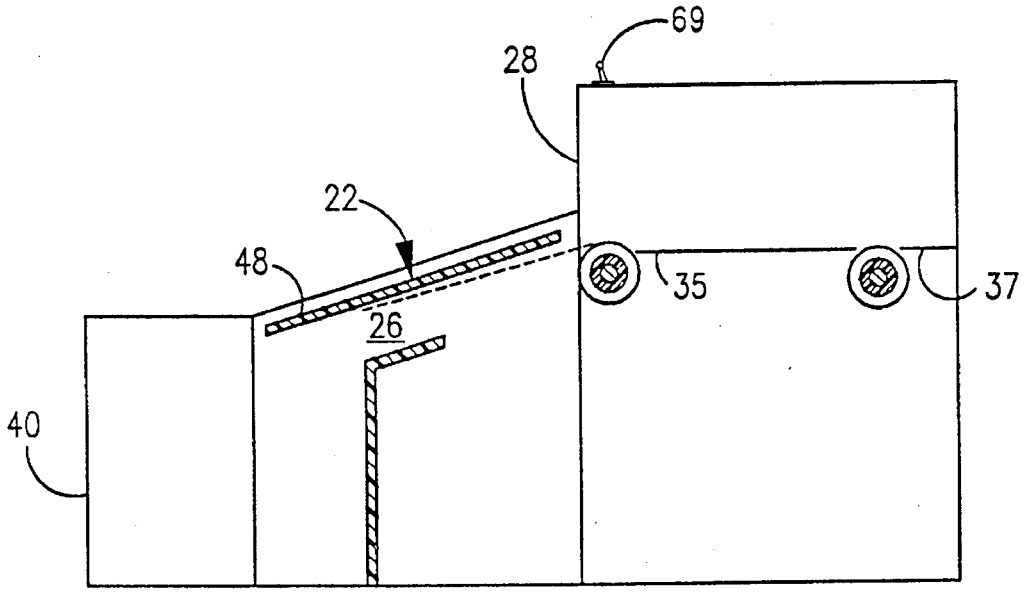
FIG. 5-B

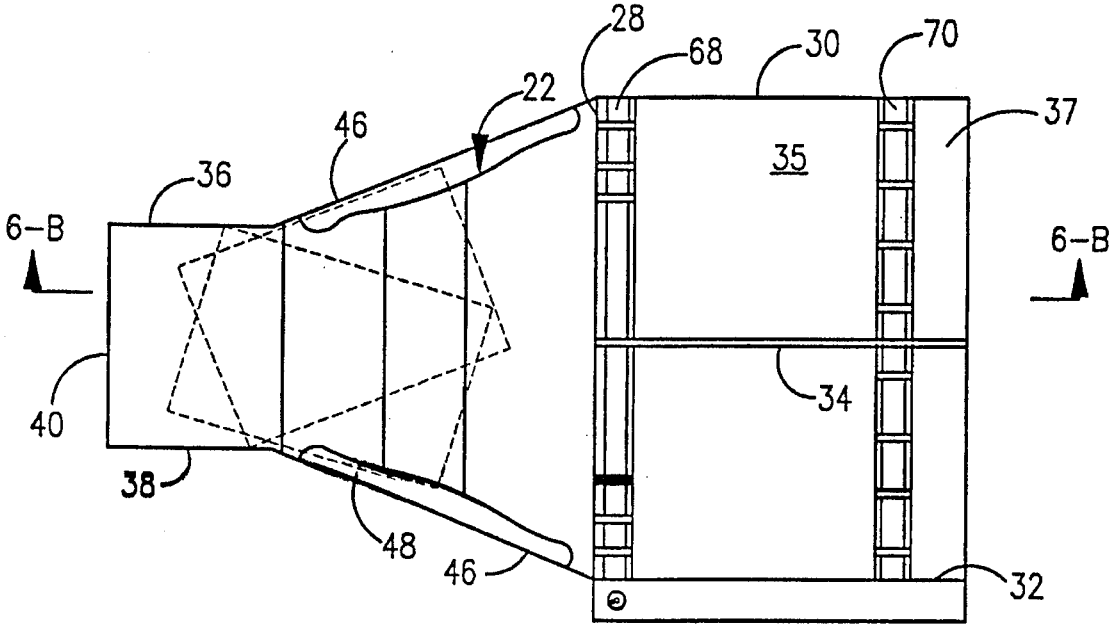
FIG. 6-A
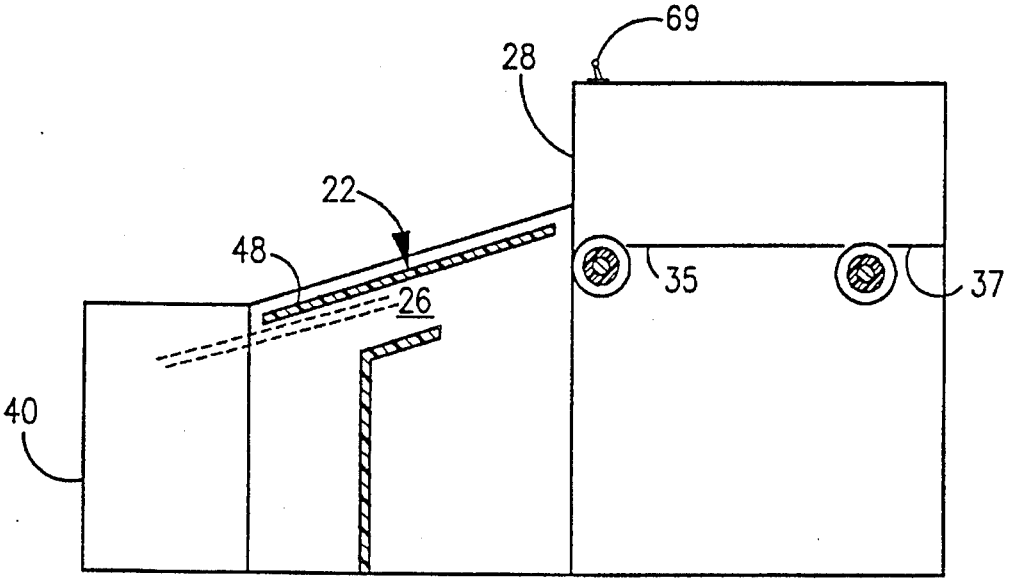
FIG. 6-B

CARD SHUFFLER APPARATUS

This is a continuation-in-part of application Ser. No. 08/215,933 filed on Mar. 22, 1994 now U.S. Pat. No. 5,445,377.

FIELD OF INVENTION

The present invention relates to a card shuffler apparatus which is operative to combine a plurality of stacks of unshuffled cards into a single stack of shuffled cards. More specifically, the present invention is directed to a card shuffler apparatus which combines two stacks of unshuffled playing cards into a single stack of shuffled playing cards. The present invention is particularly suited to shuffle multiple decks of playing cards used to play blackjack and other playing card games.

BACKGROUND OF THE INVENTION

Gaming is a popular adult pastime throughout the world. Gaming enterprises offer their gambling patrons numerous games of chance such as slot machines, poker machines, keno, dice and a variety of playing card games. One of the more popular playing card games is blackjack which is commonly referred to as "21". At a blackjack table, up to six players have an opportunity to play cards against a card dealer. The object of blackjack is to obtain a numerical card value of twenty-one (21) or less, that is greater than the card dealer's numerical card value. Any blackjack player including the dealer whose numerical card value exceeds 21 automatically loses. When using a single deck of fifty-two (52) playing cards with a full table of blackjack players, the dealer is required to shuffle the deck after every one or two games of blackjack. Shuffling is disruptive to the game of blackjack and generates an element of boredom for the blackjack players because they must wait until the dealer completes shuffling of the cards before the next game of blackjack can begin. In an attempt to eliminate this aspect of boredom during blackjack, six (6) decks of playing cards, which are dealt from a dealer shoe, have been combined in order to increase the number of games of blackjack without shuffling. Although a six (6) deck blackjack game does reduce the number of shuffles for the dealer compared to a single deck, it now takes a dealer approximately three to five minutes to shuffle six (6) decks of playing cards after the playing cards are depleted from the dealer shoe. Thus, even though the amount of shuffles have dramatically decreased while playing blackjack with a six-deck (6) dealer shoe, the period of time required to shuffle six (6) decks of playing cards has substantially increased. This increased period of time to shuffle is disruptive and stints the blackjack game, thus creating a longer period of boredom for the blackjack players.

Additionally, a few unlucky blackjack players occasionally attribute their losses to the dealer because it is falsely believed that the dealer is intentionally manipulating cards in the deck to the players' disadvantage as it is being shuffled. Although untrue, the gaming establishments are aware of this fanciful notion and consider viable alternatives to dispel this myth in order to retain integrity in the game of blackjack and bolster the interest of all blackjack players to continue playing the game. To resolve these problems, i.e. player boredom during shuffling and the notion of manually manipulating the deck during shuffling, an automatic card shuffler device has been developed.

A single deck of cards is placed into the automatic shuffler device which rests on its own stand proximate to the dealer and the blackjack table. While the dealer deals blackjack to the blackjack players with a separate deck of playing cards, the deck of playing cards within the automatic card shuffler device is being shuffled. The mechanism housed within the automatic shuffler device which drives the shuffling operations is delicate and complex. A wiper element cuts the single deck of playing cards into approximately equal stacks of unshuffled playing cards in a juxtaposed relationship. With a slight force, the mechanism urges the two stacks of unshuffled cards together along abutting ends. A probe having a conical end portion rises between the two stacks of unshuffled cards upwardly through their abutting ends. After slightly bending each stack of unshuffled cards, the playing cards return into their original flat configuration in an overlapped manner. The playing cards are then pushed together to form a single shuffled deck of cards. This process is repeated several times over a four or five minute period to assure thorough shuffling of the single deck of playing cards. After the dealer deals the shuffled deck of cards to the players, the cards are gathered and stacked into an unshuffled deck which is then exchanged for the shuffled one in the automatic card shuffler device. The game of blackjack can then immediately resume without boring the blackjack players with shuffling while eliminating any notion that the blackjack dealer is manipulating the cards during shuffling.

Indeed the automatic card shuffler device has eliminated the boredom for the players during shuffling and the notion of manually manipulating the playing cards. However, the automatic card shuffler device has adherent problems. First, the automatic shuffler device is a sophisticated and delicate device which requires regular maintenance to avoid malfunction. Second, the automatic card shuffler device can only shuffle a single deck of playing cards at a time. Third, due to the complexity of the card shuffling operation, the automatic card shuffler device is slow to shuffle a single deck of playing cards. Fourth, the single deck card shuffler device is so large that another table is typically required for its use.

Therefore, a need exists in the gaming industry to provide a new and improved automatic card shuffler apparatus. One need includes a card shuffler apparatus which is technically simple and sufficiently compact to be placed on a blackjack table. It would be an advantage to have a card shuffler apparatus which can shuffle either a single deck of playing cards or multiple decks of playing cards. It would be advantageous if the card shuffler apparatus could rapidly shuffle either a single deck or multiple decks of playing cards. The present invention addresses these needs and advantages.

SUMMARY OF INVENTION

It is an object of the present invention to provide a new and useful card shuffler apparatus which can combine at least two stacks of unshuffled cards into a single stack of shuffled cards.

It is a further object of the present invention to provide a card shuffler apparatus which is mechanically simple so that fabrication and maintenance are not problematic.

It is another object of the present invention to provide a card shuffler apparatus which is compact so that it might be placed upon a card table without substantially interfering with the game of cards being played.

Yet another object of the present invention is to provide a card shuffler apparatus which can shuffle either a single deck of playing cards or multiple decks of playing cards.

Still a further object of the present invention is to provide a card shuffler apparatus which can rapidly shuffle either a single deck of playing cards or multiple decks of playing cards.

Yet another object of the present invention is to provide a card shuffler apparatus whereby card players can observe automatic shuffling of the playing cards as a form of entertainment to reduce player boredom and eliminate the notion of manipulating the playing cards.

According to the present invention, a playing card shuffler apparatus is described which is adapted to be placed on a horizontal support surface and is operative to combine two stacks of unshuffled playing cards into a single stack of shuffled playing cards. In its broadest form, the playing card shuffling device includes a card feeder compartment, a card receiver compartment, a deflector structure and a card feeder mechanism. The card feeder compartment is sized to accommodate the two stacks of unshuffled playing cards in a juxtaposed relationship. The card receiver compartment is sized to accommodate the single stack of shuffled playing cards and is disposed below the card feeder compartment. The deflector structure defines a chute disposed between and in communication with the card feeder compartment and the card receiver compartment. The card feeder mechanism is associated with the card feeder compartment and is operative to simultaneously eject at least a bottom card in each stack of unshuffled playing cards disposed in the card feeder compartment into the chute. Ejected ones of the playing cards deflect into and descend in the card receiver compartment. The ejected cards accumulate in the card receiver compartment until all playing cards are ejected from the feeder compartment, thus forming the single stack of shuffled playing cards.

The card feeder compartment is defined by a vertical fence which is operative to prevent remaining ones in the stacks of unshuffled playing cards disposed in the card feeder compartment from entering the chute when the card feeder mechanism ejects the bottom cards in each stack of unshuffled playing cards disposed in the card feeder compartment into the chute. The card feeder compartment is further defined by a pair of vertical feeder sidewalls and a vertical divider. The pair of feeder sidewalls are spaced apart from each other in a parallel relationship and are oriented perpendicularly relative to the fence. The vertical divider extends perpendicularly relative to the fence and operates to separate the two stacks of unshuffled playing cards from one another.

The card receiver compartment is defined by a pair of vertical receiver sidewalls spaced apart from one another and parallel to the pair of feeder sidewalls. A card retainer structure extends transversely relative to the pair of receiver sidewalls and operates to retain ejected playing cards within the card receiver compartment after the card feeder mechanism ejects the single, bottom ones in each stack of unshuffled playing cards disposed in the card feeder compartment into the chute. It is preferred that the retainer structure is a door which is operative to pivot between a closed state and an opened state. In the closed state, the door prevents access into the card receiver compartment and, in the opened state, the door allows access into the receiver compartment.

The deflector structure is defined by a pair of deflector sidewalls and a deflector panel. The pair of deflector sidewalls converge from the card feeder compartment toward the card receiver compartment. It is preferred that each deflector sidewall converges from a respective one of the feeder sidewalls towards a respective one of the receiver sidewalls. The deflector panel extends between the deflector sidewalls and operates to deflect the playing cards ejected into the chute from the card feeder compartment downwardly into the card receiver compartment.

The card feeder mechanism includes a roller assembly having at least a first roller element with a first axis of rotation and a roller drive operative to impart rotational movement to the first roller element. The first roller element is adapted to extend across the card feeder compartment parallel to the fence and is disposed proximate thereto to define an opening between the fence and the first roller element. The opening is dimensioned to permit at least the bottom cards in each stack of the unshuffled playing cards to pass therethrough when the card feeder mechanism ejects at least the bottom cards in each stack of unshuffled playing cards disposed in the card feeder compartment into the chute. The roller element assembly includes a second roller element having a second axis of rotation. The second roller element is spaced apart from the first roller element and is adapted to extend across the card feeder compartment so that the axis of rotation of the first roller element and the axis of rotation of the second roller element define a roller plane. The roller plane is oriented relative to the horizontal support surface within a range of 1 degree and 10 degrees with the second axis of rotation being disposed above the first axis of rotation.

The first roller element and second roller element are mounted for rotation onto and between the feeder sidewalls and are operative to support the two stacks of unshuffled playing cards disposed in the card feeder compartment by contacting the bottom card in each stack of unshuffled playing cards. The roller assembly is operative so that the first roller element rotates more rapidly than the second roller element.

A second exemplary embodiment of the card shuffler apparatus of the present invention is adapted to shuffle stacks of any type of cards, such as cards commonly used in board games. The second exemplary embodiment of the card shuffler apparatus is operative to combine a plurality of stacks of unshuffled cards into a single stack of shuffled cards. Each stack of unshuffled cards has at least two cards. The card feeder compartment is sized to accommodate the plurality of stacks of unshuffled cards in a juxtaposed relationship. The card feeder compartment includes a plurality of vertical dividers, each extending perpendicularly relative to the fence and operative to separate the stacks of unshuffled cards disposed in the card feeder compartment from one another. The card feeder mechanism is associated with the card feeder compartment and is operative to eject at least a single card in each stack of unshuffled cards disposed in the card feeder compartment into the chute so that ejected ones of the cards deflect into and descend in the card receiver compartment to accumulate therein until all cards are ejected from the feeder compartment to form the single stack of shuffled cards.

The exemplary embodiments of the card shuffler apparatus of the present invention employ a method for combining a plurality of stacks of unshuffled cards into a single stack of shuffled cards. A first step includes placing the plurality of stacks of unshuffled cards in the card feeder compartment. The next step includes ejecting at least single ones of unshuffled cards from each stack of unshuffled cards disposed in the card feeder compartment into a chute until all cards are ejected from the card feeder compartment. The next step includes deflecting the at least single ones of the cards ejected into the chute into a card receiver compartment which is adapted to accommodate the at least single ones of the ejected cards received from the chute to form the single stack of shuffled cards.

These and other objects of the present invention will become more readily appreciated and understood from a consideration of the following detailed description of the exemplary embodiment of the present invention when taken together with the accompanying drawings, in which:

BRIEF DESCRIPTION OF DRAWINGS

FIG. 3-*a* is a top view of the card shuffler apparatus showing two stacks of unshuffled cards disposed in a card feeder compartment;

FIG. 3-*b* is a side view in cross section of the card shuffler apparatus showing a stack of unshuffled cards disposed in the card feeder compartment;

FIG. 4-*a* is a top view of the card shuffler apparatus showing a card receiver compartment accommodating a card;

FIG. 4-*b* is a side view in cross-section of the card shuffler apparatus showing a single stack of shuffled cards accumulated into the card receiver compartment;

FIG. 5-*a* is a top view of the card shuffler apparatus showing two cards being ejected from the card feeder compartment into a chute wherein the cards are being deflected;

FIG. 5-*b* is a side view in cross-section of the card shuffler apparatus showing a card ejected from the card feeder compartment into the chute wherein a card is being deflected downwardly by a deflector panel;

FIG. 6-*a* is a top view of the card shuffler apparatus showing two cards deflecting into the card receiver compartment;

FIG. 6-*b* is a side view in cross-section of the card shuffler apparatus showing two cards being deflected downwardly into the card receiver compartment;

DETAILED DESCRIPTION OF THE EXEMPLARY EMBODIMENTS

A card shuffler apparatus of the present invention is operative to combine a plurality of stacks of unshuffled cards into a single stack of shuffled cards. The card shuffler apparatus is particularly suitable to combine two stacks of unshuffled playing cards into a single stack of shuffled playing cards. A specific application for the present invention is shuffling playing cards used to play the card game, blackjack. Typically, blackjack is played with either one deck of playing cards, two decks of playing cards or six decks of playing cards. The present invention can shuffle the playing cards necessary to play blackjack or any other playing card game employing multiple decks of playing cards. Additionally, the present invention can be adapted to combine a plurality of stacks of other types of cards into a single stack of shuffled cards. For example, cards used in family board games or trivia games can be shuffled by the present invention.

Figure 1:
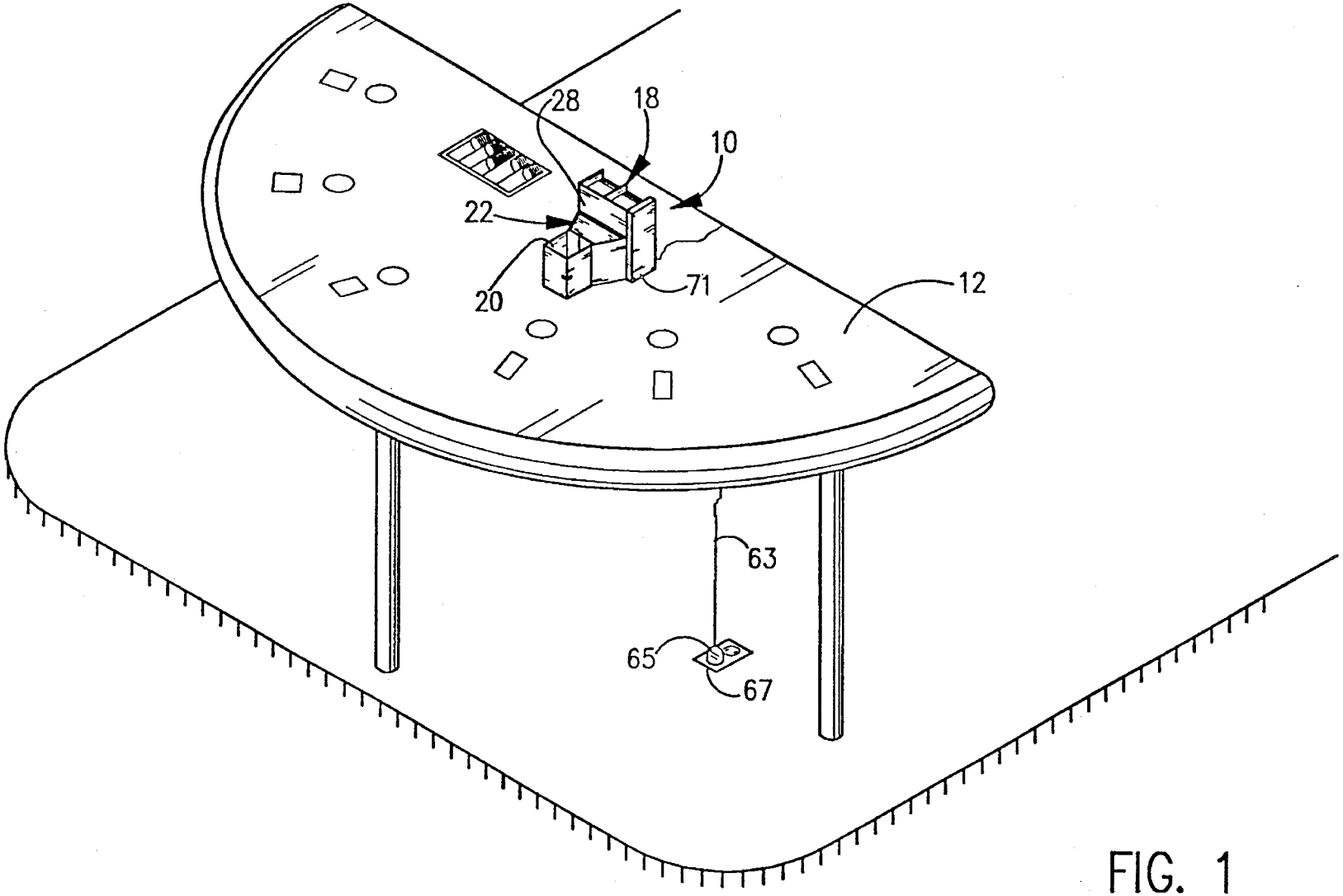
FIG. 1 is a perspective view of a card shuffler device of the present invention placed upon a blackjack table.
Figure 2:
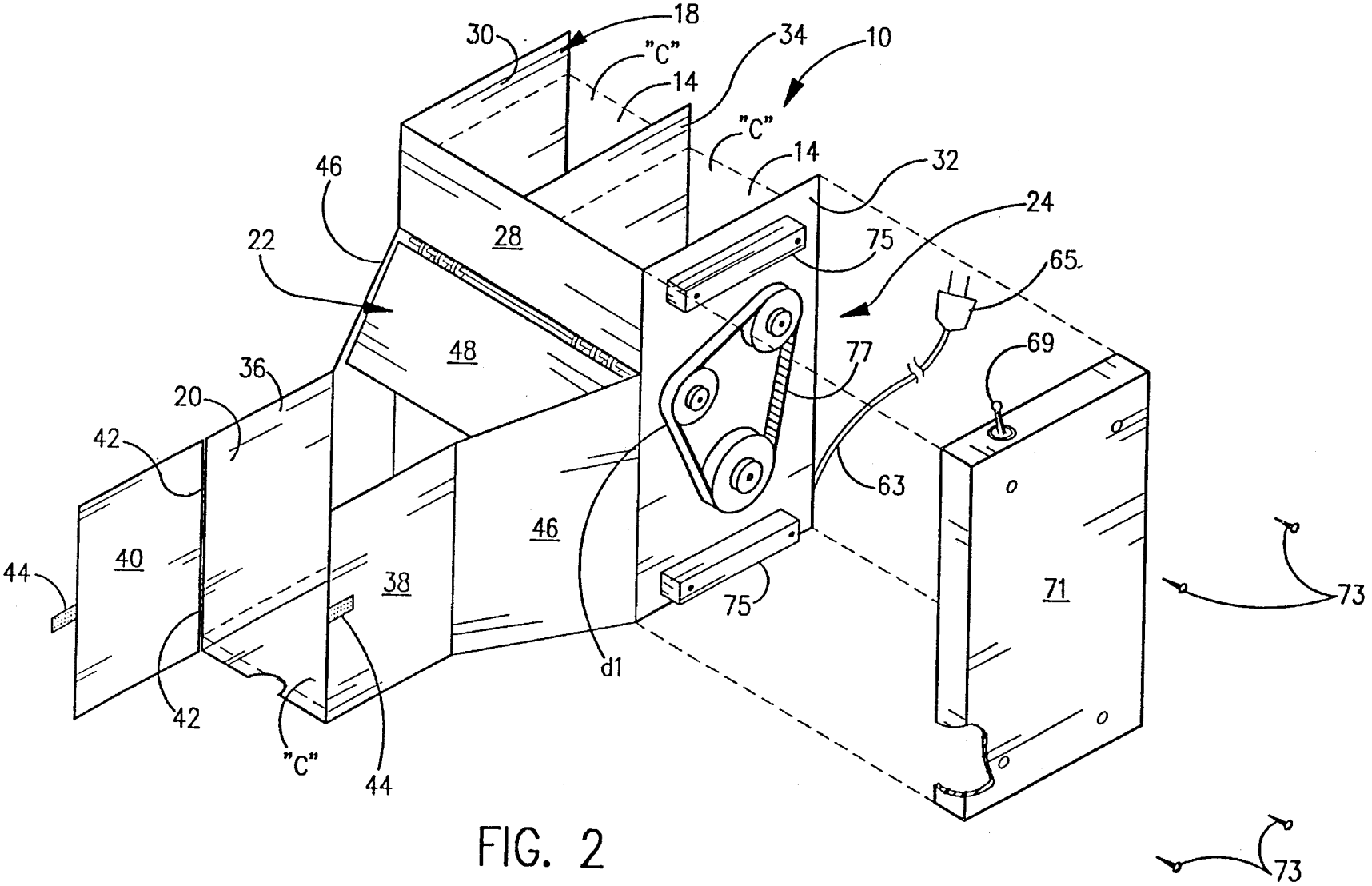
FIG. 2 is an enlarged partially exploded perspective view of the card shuffler apparatus of the present invention shown in FIG. 1.

A card shuffler apparatus 10 of the present invention is generally introduced in FIGS. 1–8. As best shown in FIGS. 1 and 2, card shuffler apparatus 10 is adapted to be placed on a horizontal support surface 12 such as a blackjack table or other type of table. For simplicity of illustrating the present invention and where appropriate, each playing card "c" is represented by dashed lines. Card shuffler apparatus 10 is operative to combine two stacks 14 of unshuffled playing cards "c" as best shown in FIGS. 3-*a* and 3-*b* into a single stack 16 of shuffled playing cards "c" as best shown in FIGS. 4-*a* and 4-*b*. Card shuffler apparatus 10 includes a card feeder compartment 18, a card receiver compartment 20, a deflector structure 22 and a card ejector mechanism 24. As shown in FIGS. 2, 3-*a* and 3-*b*, card feeder compartment 18 is sized to accommodate the two stacks 14 of unshuffled playing cards "c" in a juxtaposed relationship. With reference to FIGS. 2, 4-*a* and 4-*b*, card receiver compartment 20 is sized to accommodate the single stack 16 of shuffled playing cards "c" and is disposed below card feeder compartment 18. Deflector structure 22 defines a chute 26 which is disposed between and in communication with card feeder compartment 18 and card receiver compartment 20. Card ejector mechanism 24 is associated with card feeder compartment 18 and is operative to simultaneously eject at least a bottom card "c'", as shown in FIG. 3-*b*, in each stack 14 of unshuffled playing cards "c" disposed in card feeder compartment 18 into chute 26. Now, ejected ones of the playing cards "c" deflect into and descend in card receiver compartment 20, as best shown in FIGS. 5-*a*, 5-*b*, 6-*a* and 6-*b*, in order to accumulate in card receiver compartment 20 until all playing cards "c" are ejected from card feeder compartment 18 thereby forming the single stack 16 of shuffled playing cards "c" as shown in FIGS. 4-*a* and 4-*b*.

Figure 9:
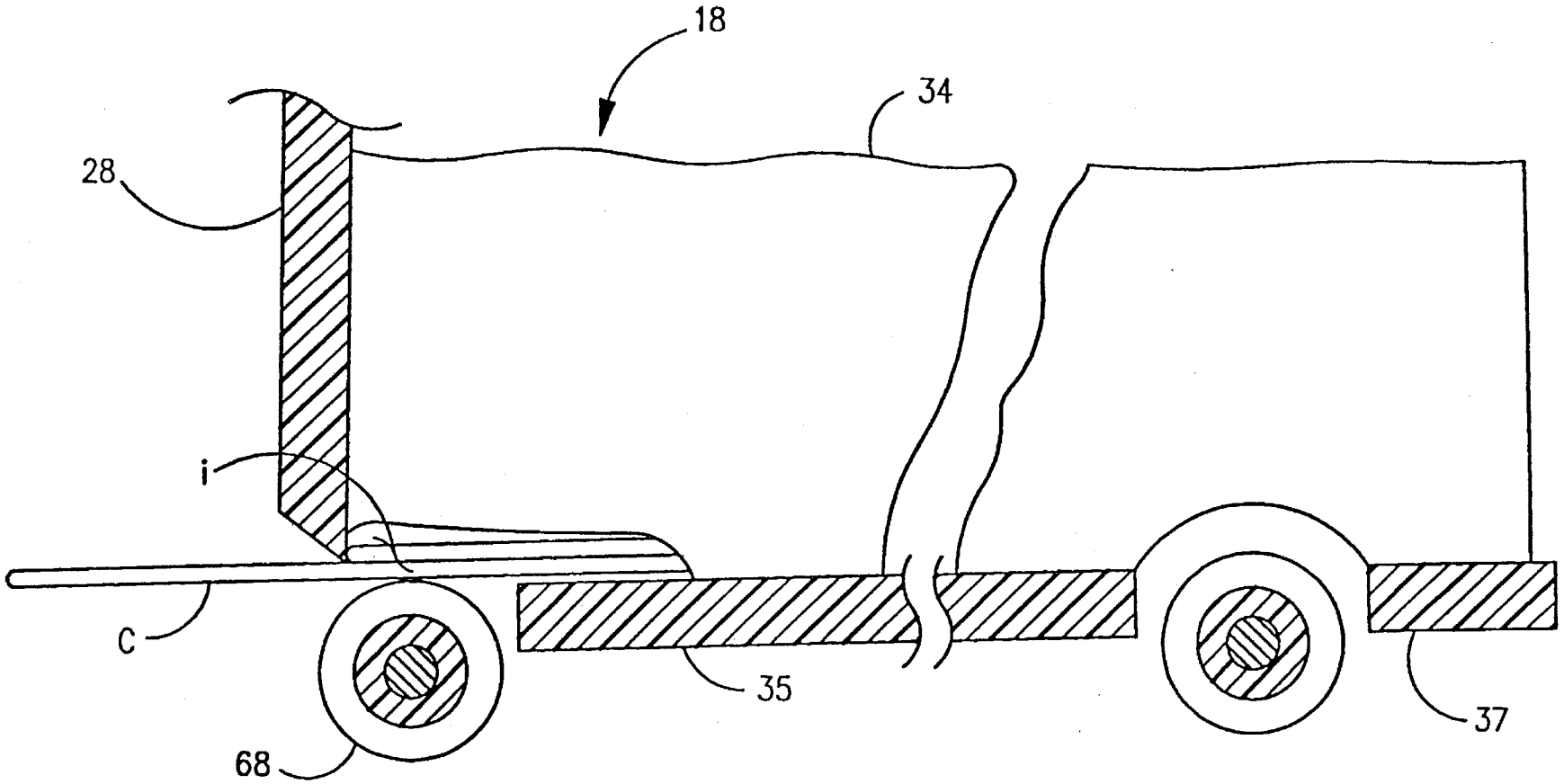
FIG. 9 is an enlarged side elevational view partially in cross-section showing a fence, first and second feeder floor panels and a divider of the card feeder compartment.

Card feeder compartment 18 is defined by a vertical fence 28 which is operative to prevent remaining ones in the two stacks 14 of unshuffled playing cards "c" disposed in card feeder compartment 18 from entering chute 26 when card ejector mechanism 24 ejects the bottom cards "c" in each stack 14 of unshuffled playing cards "c" disposed in feeder compartment 18 into chute 26. Card feeder compartment 18 is also defined by a pair of vertical feeder sidewalls 30 and 32 and a vertical divider 34. The pair of feeder sidewalls 30 and 32 are spaced apart from each other in a parallel relationship and are oriented perpendicularly relative to fence 28. The pair of feeder sidewalls 30 and 32 and fence 28 are connected together. Divider 34 extends perpendicularly relative to fence 28 and is operative to separate the two stacks 14 of unshuffled playing cards "c" from one another. Card feeder compartment 18 is further defined by a first feeder floor panel 35 and a second feeder floor panel 37 which are spaced apart from each other and extend between feeder sidewalls 30 and 32. Divider 34 is connected to fence 28 and to first and second feeder floor panels 35 and 37 as shown in FIG. 9. Note, an indentation "i" as shown in FIG. 9 is formed between first feeder floor panel 35 and divider 34 proximate to fence 28 which is sized to permit at least a portion of one card "c" to pass therethrough and under fence 28.

Figure 7:
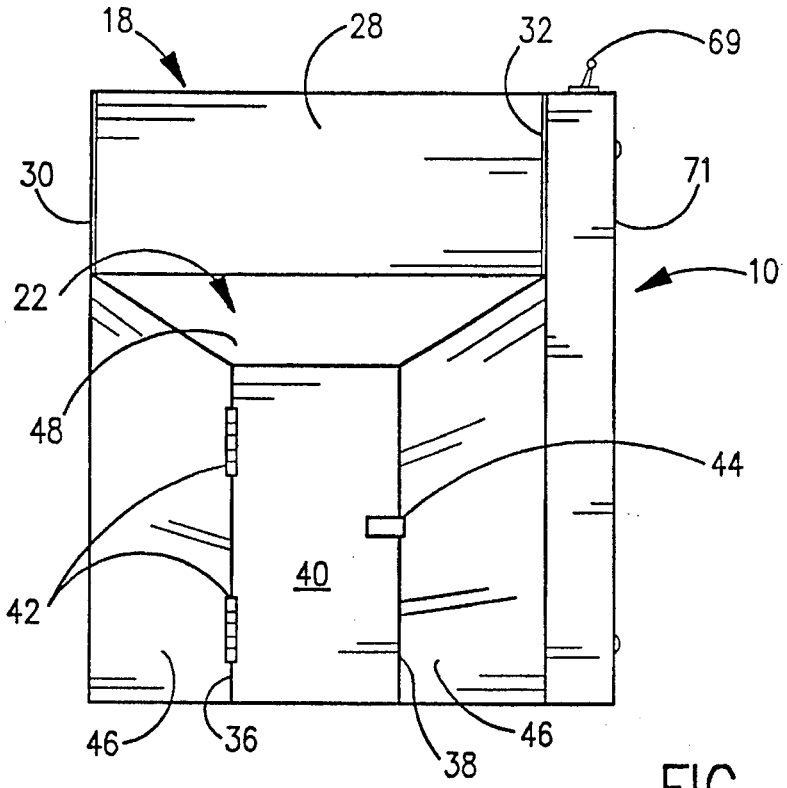
FIG. 7 is a front elevational view of the card shuffler apparatus shown in FIGS. 1 and 2.

Card receiver compartment 20 is defined by a pair of vertical receiver sidewalls 36 and 38 which are spaced apart from and parallel to one another and are oriented parallel to the pair of feeder sidewalls 30 and 32. A card retainer structure 40 extends transversely relative to the pair of receiver sidewalls 36 and 38 and is operative to retain ejected ones of the playing cards within card receiver compartment 20 after card ejector mechanism 24 ejects the single, bottom cards "c'" in each of the two stacks 14 of unshuffled playing cards "c" disposed in card feeder compartment 20 into chute 26. Although not by way of limitation to the present invention, card retainer structure 40 is a conventional door which is pivotally connected to receiver sidewall 36 by a pair of hinges 42 as best shown in FIGS. 2 and 7. The door is operative to pivot between a closed state (FIG. 7) and an opened state (FIG. 2). In the closed state, the door prevents access into card receiver compartment 20 and, in the opened state, the door allows access into card receiver compartment 20. A mating pair of hook and loop fasteners 44 are connected respectively to the door and receiver sidewall 38 so that the door can be retained in its closed state when desired.

Deflector structure 22 includes a pair of deflector sidewalls 46 and a deflector panel 48. In FIG. 3-*a*, the pair of deflector sidewalls 46 converge from card feeder compartment 18 towards card receiver compartment 20. Specifically, each deflector sidewall 46 converges from a respective one of feeder sidewalls 30 and 32 towards a respective one of receiver sidewalls 36 and 38. Each deflector sidewall 46 forms an angle "a" with fence 28. Although it is preferred that angle "a" is seventy degrees (70°), angle "a" can be any select angle within a range between sixty degrees (60°) and eighty degrees (80°). As best shown in sequence in FIGS. 5-*a* and 6-*a*, deflector sidewalls 46 are operative to deflect ejected ones of the cards "c" into card receiver compartment 20.

Deflector panel 48 extends between deflector sidewalls 46 and is operative to deflect the playing cards "c" ejected into chute 26 from card feeder compartment 18 downwardly into card receiver compartment 20 as best shown in FIG. 5-*b*. With reference to FIG. 3-*b*, deflector panel 48 defines an angle "b" with an imaginary plane "P" which extends parallel with horizontal support surface 12. Although it is preferred that angle "b" is thirty degrees (30°), angle "b" can be selected from a range of twenty degrees (20°) and forty degrees (40°). A bulkhead 50 extends vertically and between deflector sidewalls 46. A deflector floor panel 52 is connected to bulkhead 50 and extends between deflector sidewalls 46.

Figure 8:
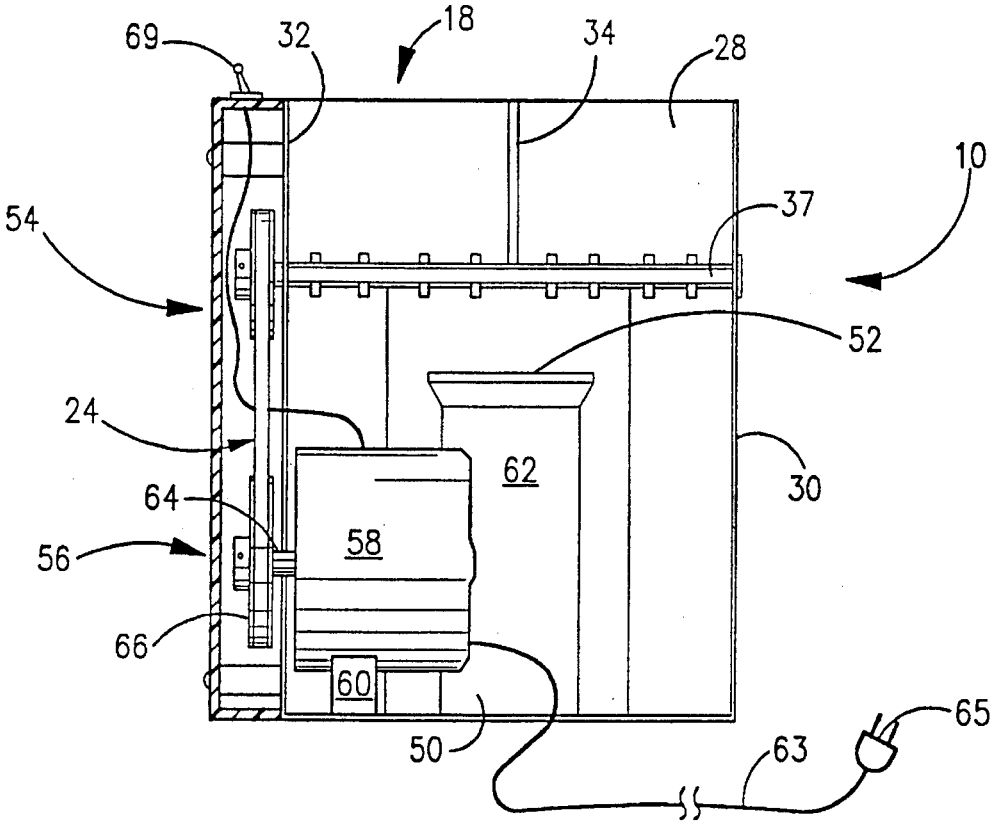
FIG. 8 is a rear elevational view partially in cross-section showing a roller assembly and a roller drive.

Although one of ordinary skill in the art would appreciate that other types of card ejector mechanism are available for the present invention, only one is described herein as the preferred mechanism. With reference to FIG. 8, card ejector mechanism 24 includes a roller assembly 54 and a roller drive 56 which is operative to impart rotational movement to roller assembly 54. Roller drive 56 includes an electric motor 58 mounted by a mounting element 60 within an interior 62 formed below card feeder compartment 18 and between feeder sidewalls 30 and 32. A conventional electrical cable 63 with a conventional plug 65 supplies power to electric motor 58 through a conventional socket 67. A conventional switch 69 mounted to cover 71 is employed to activate or deactivate electric motor 58. A motor shaft 64 extends through feeder sidewall 32 and connects to roller drive pulley 66. It is preferred that roller drive pulley 66 is a positive traction type.

Figure 10:
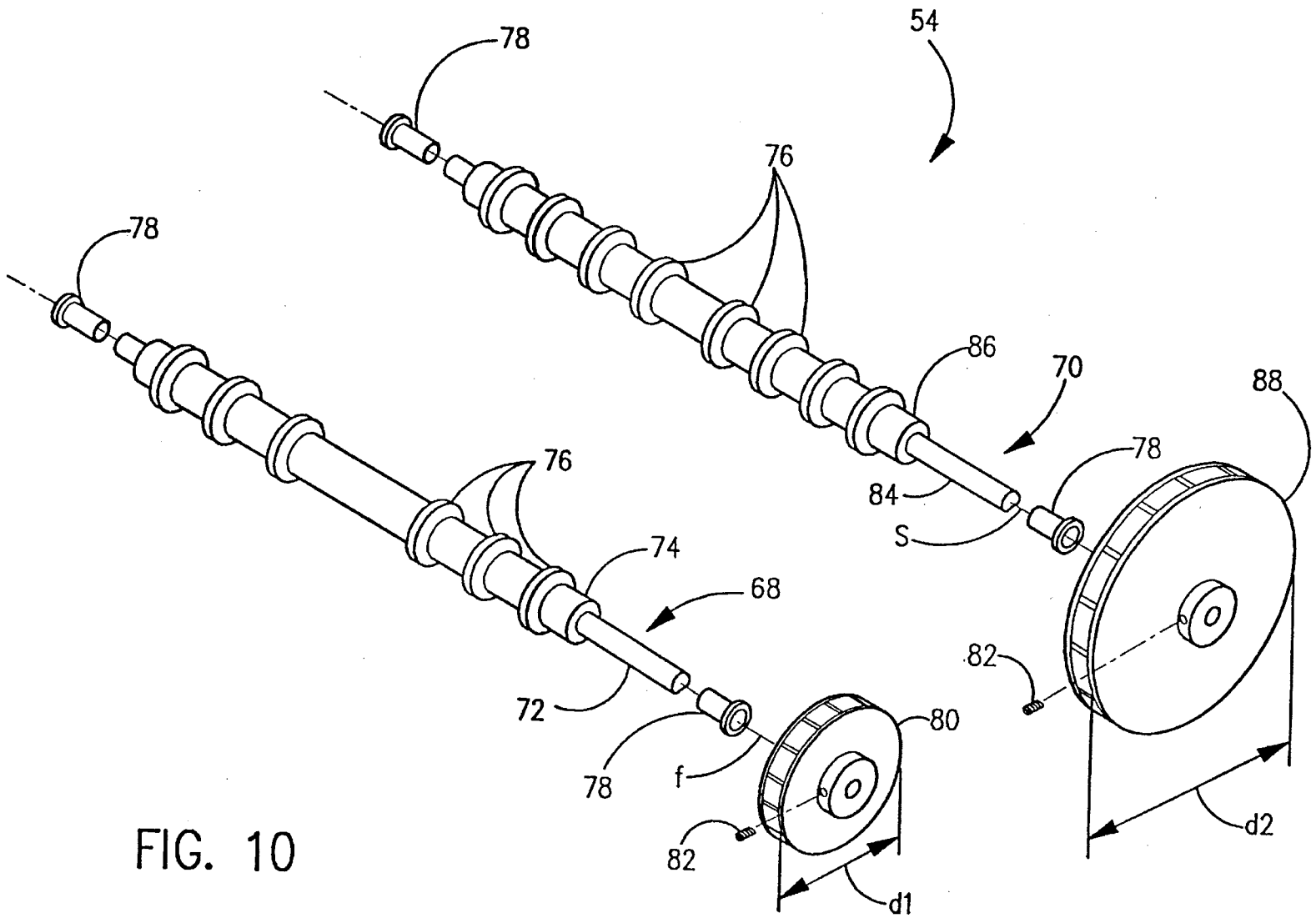
FIG. 10 is a perspective view showing a first and a second roller element of the roller drive assembly.

With reference to FIG. 10, roller assembly 54 includes a first roller element 68 and a second roller element 70. First roller element 68 has a first axis of rotation "f" and second roller element 70 has a second axis of rotation "s". First roller element 68 includes a first roller shaft 72 having a first roller sleeve 74 slidably connected thereto. It is preferred that first roller sleeve 74 is a tube fabricated from a pliable material such as rubber or plastic. A plurality of o-rings 76 preferably fabricated from a rubber material are slidably fitted over first roller sleeve 74. First roller element 68 also includes a pair of bearings 78 fabricated from Teflon which receives opposite end portions of first roller shaft 72 and a first roller pulley 80 adapted to connect to an end portion of first roller shaft 72 by a set screw 82.

Second roller element 70 includes a second roller shaft 84 having a second roller sleeve 86 slidably mounted thereon. A plurality of o-rings 76 are slidably mounted onto second roller sleeve 86. Second roller element 70 also includes a pair of bearings 78 which slidably receives opposite end portions of shaft 84 and a second roller pulley 88 which is fastened to an end portion of shaft 84 by set screw 82. Second roller pulley 88 has a larger diameter "d2" than a diameter "d1" of first roller pulley 80 so that roller assembly 54 is operative whereby first roller element 68 rotates more rapidly than second roller element 70. Once all of the pulleys are fastened to respective end portions of the shafts, a continuous belt 77 is fitted around the pulleys to impart rotational movement roller assembly 54. It is preferred that belt 77 is a positive traction type operative to matably engage with the positive traction type pulleys.

Figure 11:
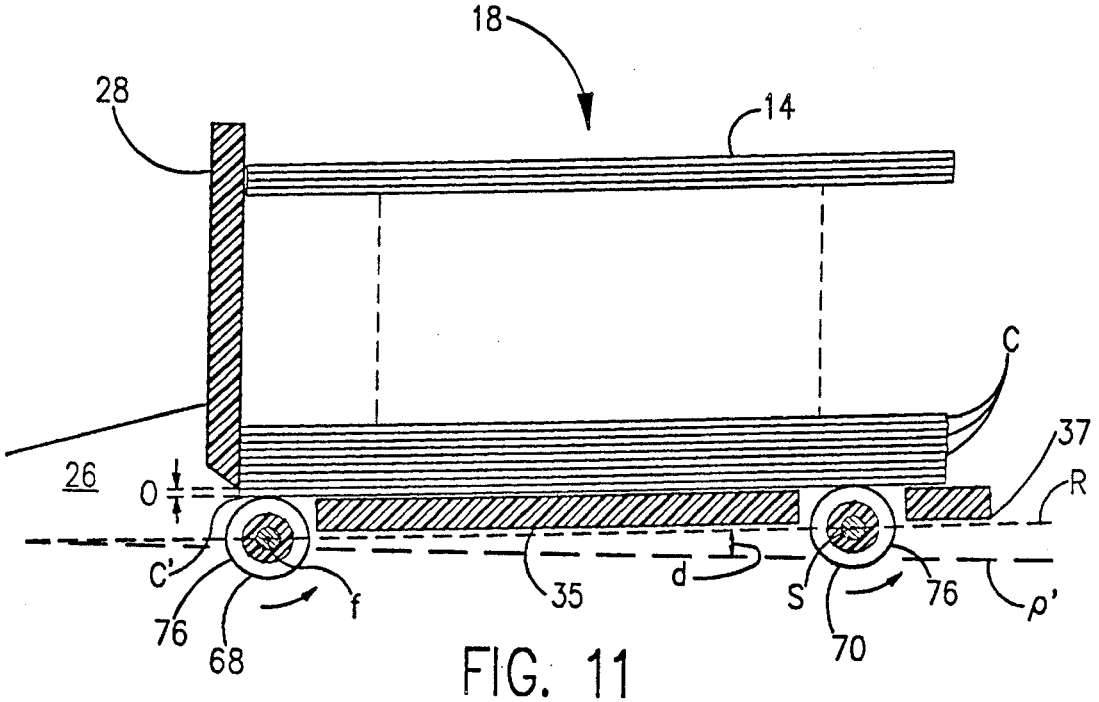
FIG. 11 is a side elevational view in cross-section of the card feeder compartment and the first and second roller elements immediately before a bottom card in a stack of unshuffled cards is ejected into the chute.
Figure 12:
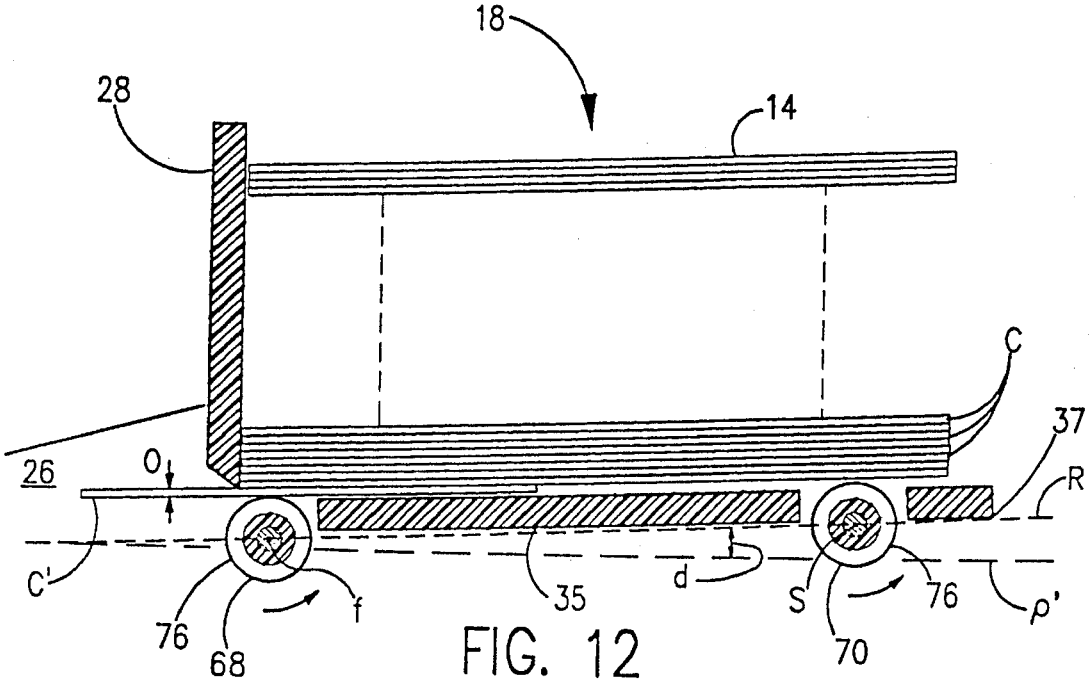
FIG. 12 is a side view in cross-section of the card feeder compartment and the first and second roller elements showing a bottom card being ejected from the card feeder compartment and into the chute.

In FIG. 3-*a*, first roller element 68 is adapted to extend across card feeder compartment 18 and parallel to fence 28. First roller element 68 is disposed proximate to fence 28 to define an opening "o" therebetween as shown by FIGS. 11 and 12. Opening "o" is dimensioned to permit at least the bottom card "c'" in each stack 14 of unshuffled playing cards "c" to pass therethrough when card ejector mechanism 24 ejects at least bottom cards "c'" in each stack 14 of unshuffled playing cards "c" disposed in card feeder compartment 18 into chute 26. One of ordinary skill in the art would appreciate that it is possible that a plurality of cards "c" including bottom card "c'" could be forced through opening "o" without departing from the spirit of the invention. With reference again to FIG. 3-*a*, second roller element 70 is spaced apart from first roller element 68 in a parallel relationship and is also adapted to extend across card feeder compartment 18 between and above first and second feeder floor panels 35 and 37. As shown in FIGS. 11 and 12, first access of rotation "f" of first roller element 68 and second access of rotation "s" of second roller element 70 define a roller plane "r". Roller plane "r" is oriented relative to an imaginary plane "P'" which extends parallel to horizontal support surface 12 at an angle "d". Although it is preferred that angle "d" is five degrees (5°), angle "d" can be in a range between one degree (1°) and ten degrees (10°). Note that second axis of rotation "s" is disposed above the first access of rotation "f" relative to the imaginary horizontal plane "P" so that the cards "c" are ejected from card feeder compartment 18 into chute 26 at a slightly downwardly angle.

As shown in FIGS. 3-*a*, 11 and 12, first roller element 68 and second roller element 70 are operative to support the two stacks 14 of unshuffled playing cards "c" disposed in card feeder compartment 18 by contacting the bottom card "c'" in each stack 14 of unshuffled playing cards "c". As card shuffler apparatus 10 is activated, first roller element 68 and second roller element 70 rotate in a direction shown by the arrows. Rotating o-rings engage bottom ones from each stack 14 of unshuffled cards to eject the bottom cards into chute 26. Note that in FIG. 12, as bottom card "c'" is being ejected from card feeder compartment 18, o-rings 76 rotating on second roller element 70 contact the next card "c" in preparation for its ejection from card feeder compartment 18. Therefore, although not by way of limitation, it is considered that the present invention continuously ejects bottom ones of cards "c" in sequence. In other words, as the bottom ones "c'" of the cards in each stack of unshuffled cards are ejected from the card feeder compartment, the succeeding card then becomes the bottom card. Furthermore, although the card feeder mechanism is operable to simultaneously eject bottom ones of the cards from each stack of unshuffled cards, the cards themselves are not necessarily simultaneously ejected from the feeder compartment. For example, two of the bottom-most cards in one stack of unshuffled might stick together momentarily, thus causing asynchronous ejection of cards from each stack. Thus, proper operation of the present invention is insensitive to simultaneous ejection of the cards from each stack.

Figure 13:
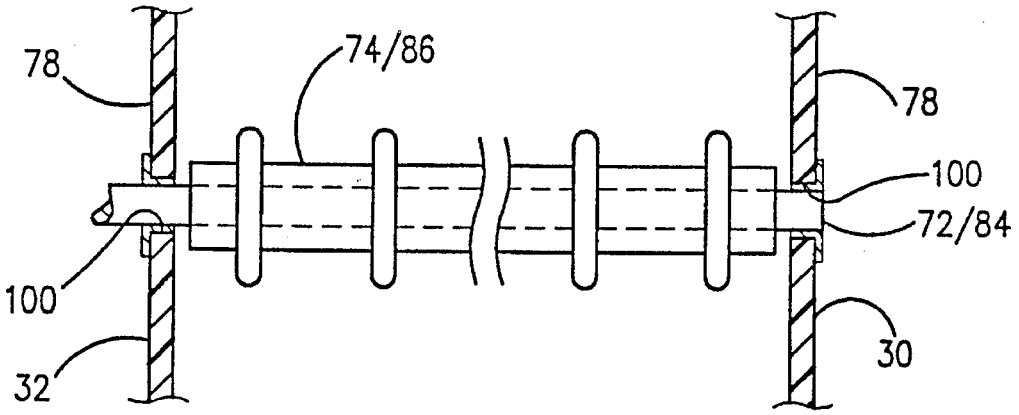
FIG. 13 is an enlarged elevational view of a roller element mounted for rotation into and between a pair of feeder sidewalls of the card feeder compartment.

FIG. 13 depicts for illustration purposes either first roller element 68 or second roller element 70 mounted for rotation onto and between feeder sidewalls 30 and 32. Bearings 78 are force fitted through respective holes 100 formed into feeder sidewalls 30 and 32. Bearings 78 may also be glued therein with an adhesive. Roller shaft 72 or 84 is received into bearings 78 for rotation. Roller sleeve 74 or 86 is sized so that it can extend between feeder sidewalls 30 and 32 in a manner to prevent roller shaft 72 or 84 from sliding out of bearings 78. Thus, when disassembling card shuffler apparatus 10 for maintenance or repair, roller shaft 72 or 84 can simply be slidably removed from roller sleeve 74 or 86. When card shuffler apparatus 10 is fully assembled, cover 71 is secured over the pulleys and belt by screws 73 fastened to mounting blocks 75, as shown in FIG. 2.

Figure 14:
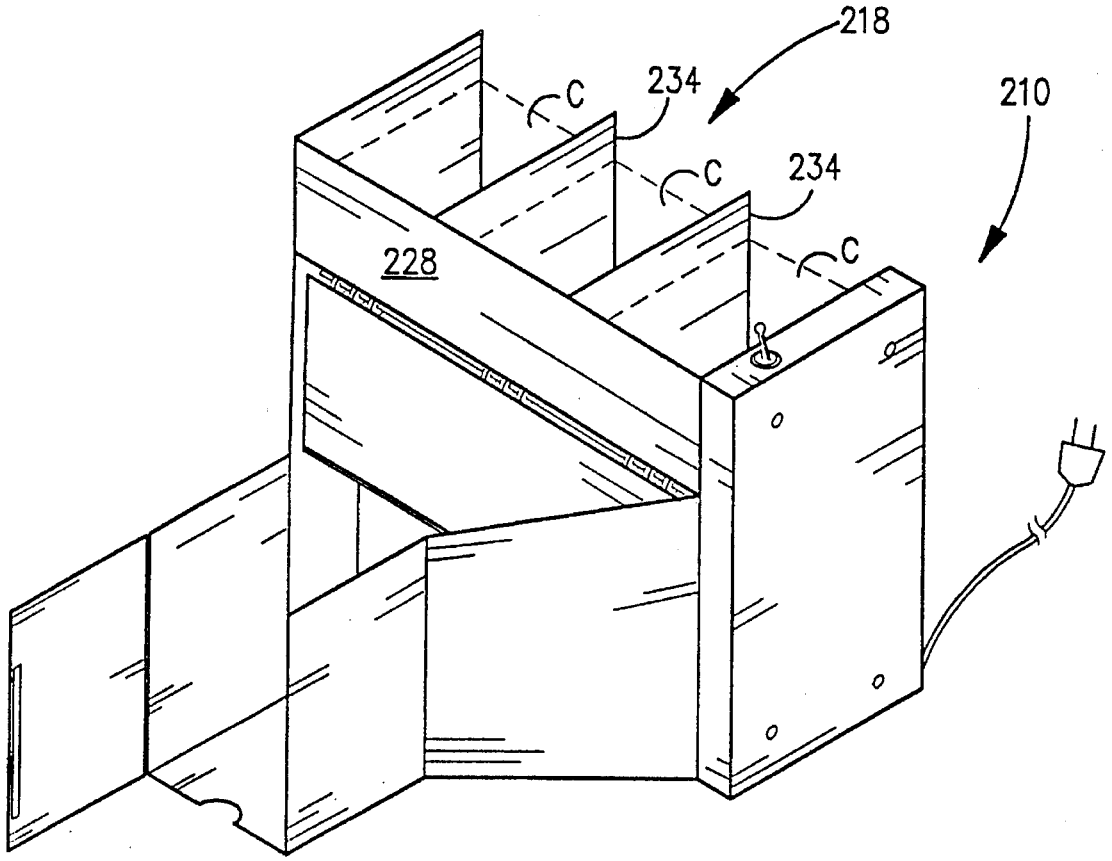
FIG. 14 is a perspective view of a second exemplary embodiment of the card shuffler apparatus of the present invention.

As shown in FIG. 14, a second exemplary embodiment of a card shuffler apparatus 210 of the present invention is shown. Card shuffler apparatus 210 is adapted for use with any type of cards, such as cards used in family board games or trivia games. Card shuffler apparatus 210 is operative to combine a plurality of stacks of unshuffled cards into a single stack of shuffled cards. Each stack of unshuffled cards has at least two cards. Card feeder compartment 218 is sized to accommodate the plurality of stacks of unshuffled cards in a juxtaposed relationship. Card feeder compartment 218 includes a plurality of vertical dividers 234 extending perpendicularly relative to a fence 228 and is operative to separate the plurality of stacks of unshuffled cards from one another.

The exemplary embodiments of the card shuffler device of the present invention employ a method for combining a plurality of stacks of unshuffled cards into a single stack of shuffled cards. A first step includes placing the plurality of stacks of unshuffled cards in a card feeder compartment. The next step includes ejecting at least single ones of unshuffled cards from each stack of unshuffled cards disposed in the card feeder compartment into a chute until all cards are ejected from the card feeder compartment. The next step includes deflecting the single ones of the cards ejected into the chute in a card receiver compartment which is adapted to accommodate single ones of the ejected cards received from the chute to form the single stack of shuffled cards.

One of ordinary skill in the art would appreciate the advantages afforded by the card shuffler apparatus of the present invention. The card shuffler apparatus is mechanically simple and, therefore, its fabrication and maintenance are not problematic. The card shuffler apparatus is also compact so that it may be placed upon a card table without substantially interfering with the game of cards being played. Since the card shuffler apparatus can be placed on a card table, the card players can observe shuffling of the playing cards as a form of entertainment to reduce player boredom during card shuffling. The card shuffler apparatus is versatile in that it can shuffle either a single deck of cards or multiple decks of cards. Furthermore, experiments have shown that the card shuffler apparatus of the present invention can shuffle six (6) decks of unshuffled cards in approximately seventeen (17) seconds. A dealer would require three (3) to five (5) minutes to shuffle six (6) decks of cards. Therefore, the card shuffler apparatus can rapidly shuffle either a single deck of cards or multiple decks of cards.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

Improved Embodiment of the Present Invention

The following embodiments include several optional features which improve performance and manufacturability of the card shuffler in accordance with the present invention. While the basic embodiment described hereinbefore operates well, the improvements described hereinafter provide somewhat more reliable and random shuffling of the cards.

The overall purpose of the improved optional features is to more closely duplicate a manual shuffle while achieving the speed advantages of a mechanized device. In addition to simulating a manual shuffle, the improvements seek to prevent the shuffler apparatus from introducing any changes to the mix of cards in the shuffled deck caused by cards sticking or failing to mix or interleave properly as they pass through the shuffler.

Figure 15:
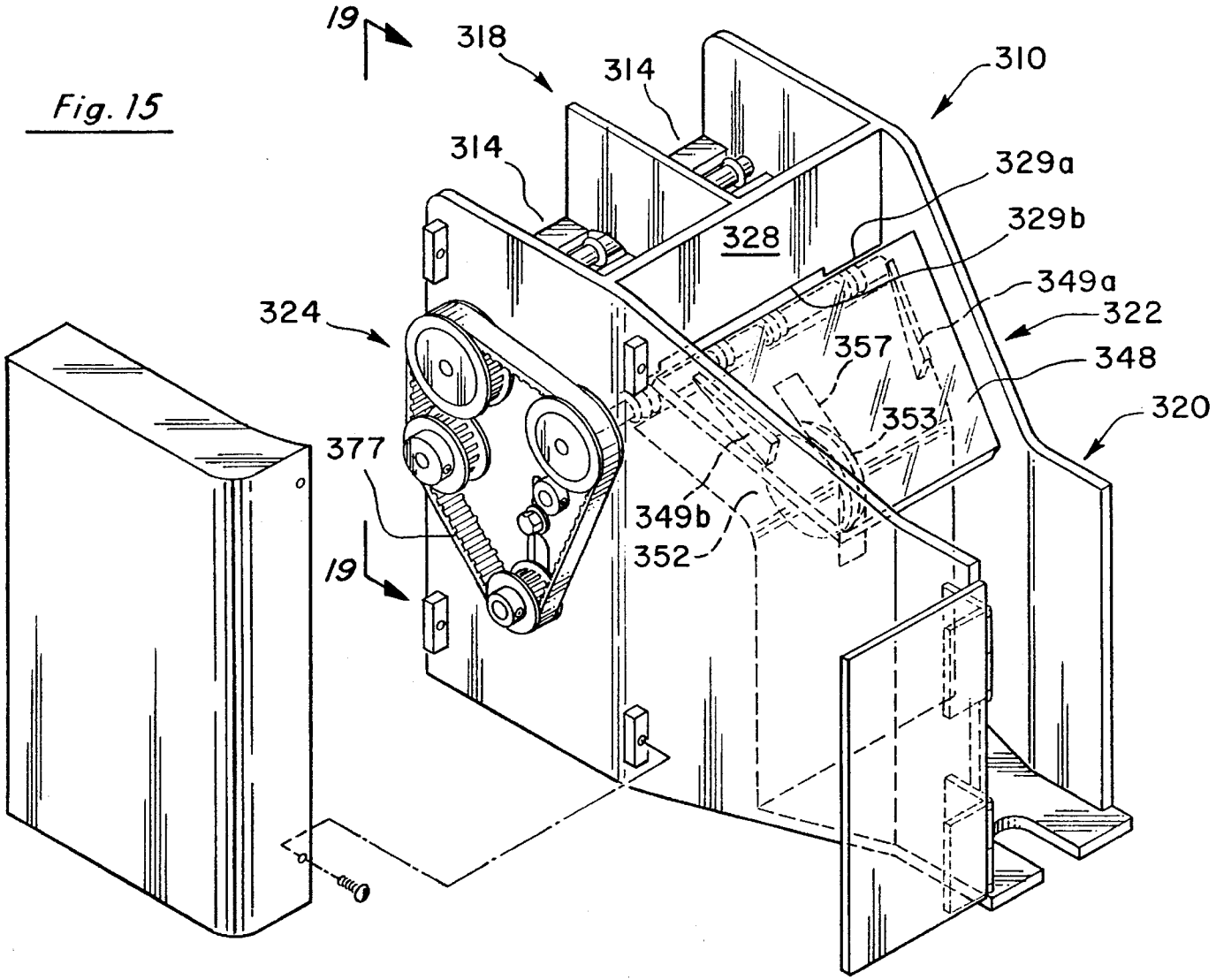
FIG. 15 is a partially exploded perspective view of an improvement of the card shuffler apparatus in accordance with the present invention.
Figure 16:
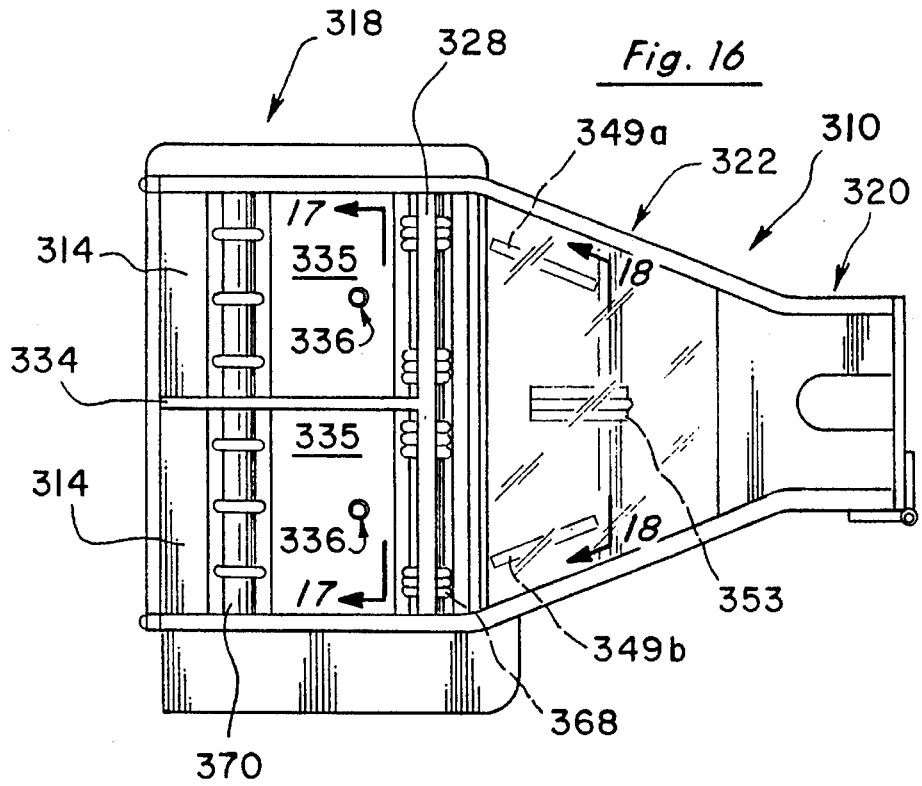
FIG. 16 is a rear elevational view of the improvement showing a roller assembly and a roller drive.

FIG. 15 and FIG. 16 illustrate in overview the optional improvements in accordance with the present invention. Card shuffler apparatus 310 is substantially similar to the card shuffler 10 described hereinbefore. To ease description and understanding, only the optional improvements that differ from card shuffler 10 are described here in detail. It should be understood that elements of card shuffler apparatus 310 not described herein can be fully understood by reference to the detailed description of card shuffler apparatus 10.

Card shuffler apparatus 310 includes a card feeder compartment 318 having two or more sections 314 for holding stacks of unshuffled cards (not shown). Card shuffler apparatus 310 also includes a receiver compartment 320, deflector structure 322 and a card ejector mechanism 324. Receiver compartment 320 does not differ from receiver compartment 20 of card shuffler apparatus 10, and will not be described in detail here.

As shown in FIG. 15, a modified fence 328 defines one boundary of card feeder compartment 318. Modified fence 328 includes a contoured lower surface that forms a variable height slot 329*a*–329*b* described hereinbelow. Deflector structure 322 includes a modified upper deflector panel 348 having deflector bars 349 extending therefrom. Lower deflector panel 352 includes a lazy card ejector mechanism 353. Card ejector mechanism 324 is modified to include drive means (shown in FIG. 19 and FIG. 20) for the lazy card ejector mechanism 353. Also, card ejector mechanism 324 includes additional drive means for pseudo-random shuffler mechanism 336 shown in FIG. 16 and FIG. 17. These improvements are described individually below, but it should be understood that they can be combined with card shuffler apparatus 310 to interact as shown in FIG. 15 and FIG. 16.

Card Ejection

It is desirable that the automatic card shuffler in accordance with the present invention simulate as closely as possible the random shuffling action provided by manual shuffling. Manual shuffling does not result in one-to-one interleaving of two stacks of cards. It is desirable if several cards from one stack of unshuffled cards are fed into deflector structure 322 followed by one or more cards from another stack of unshuffled cards. To achieve this, a feature of the improved embodiment is a mechanism for momentarily interrupting the ejection of cards from one of the stacks of unshuffled cards, allowing some number of cards to eject from the other stack.

Figure 17:
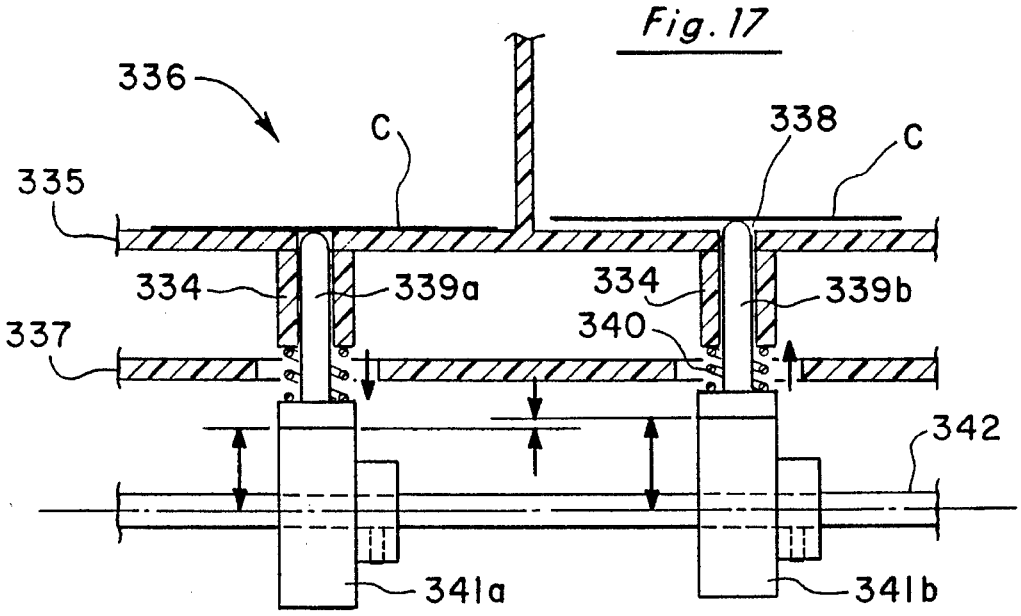
FIG. 17 is a side view in cross-section of the improvement.

As shown in FIG. 17, the pseudo-random shuffling is achieved by a pair of plungers 339*a* and 339*b* that extend through the feeder compartment floor panel 335 into card feeder compartment 318. The pseudo-random ejection mechanism 336 enters card feeder compartment 318 through holes 338 (visible in FIG. 17) near roller 368 and fence 328 as shown in FIG. 16. Plungers 339*a* and 339*b* move into and out of card feeder chamber 318. When a plunger 339*a* or 339*b* extends into card feeder chamber 318 it engages the exiting card "c" forcing it upward and out of contact of roller 76.

Additionally, the card "c" engaged by a plunger 339*a* or 339*b* is pushed upward against fence 328 so as to stop or interrupt the ejection of cards from that stack. Meanwhile, cards from the other stack(s) are being ejected. Plungers 339*a* and 339*b* are provided such that one plunger is positioned in each section 314 of feeder compartment 318 so as to engage each stack of unshuffled cards. By alternately moving plungers 339*a* and 339*b* into and out of card feeder compartment 318 the pseudo-random card ejection is achieved. It is to be understood that only one plunger for one stack could be used and that any pattern preventing ejection (including pseudo-random) could be used.

As shown in FIG. 17, the plungers can be driven by a simple cam structure. A spindle 342 is mounted in parallel with fence 28 underneath feeder compartment floor panel 335 and sub-floor panel 337. Subfloor panel 337 serves primarily for structural support. Cams 341*a* and 341*b* are mounted on the spindle such that one cam is aligned under each plunger 339*a* and 339*b*. Plungers 339*a* and 339*b* are sized so that one end contacts a cam 341*a* or 341*b* and is moved up and down as the spindle 342 is rotated. Springs 340 serve to force plungers 339*a* and 339*b* to return to position against the appropriate cam 341*a* or 341*b*.

Two plungers are shown in the preferred embodiment, but it should be understood that one plunger 339*a* or 339*b* may be used if it is acceptable to interrupt only one stack of unshuffled cards. Where multiple plungers 339*a* and 339*b* are used, cams 341*a* and 341*b* are aligned such that the plungers do not enter feeder compartment 318 at the same time so as to interrupt ejection of all of the stacks of unshuffled cards. Cam 341*a* is shown in a position in which plunger 339*a* is fully recessed out of card feeder compartment 318. At the same time, cam 341*b* is positioned so that plunger 339*b* is fully extended into feeder compartment 318. In a specific example, total travel of plungers 339*a* and 339*b* is 1/16 inch to 13/16 inch, which is defined by the shape of cams 341*a* and 341*b*.

The shape of cams 341*a* and 341*b* can be altered to affect the amount of time that each stack is interrupted or to provide more than one interruption per rotation of the spindle 341. As an example, spindle 342 is driven at one cycle per second or two cycles per second, with each cycle providing one extension of each plunger 339*a* and 339*b* into feeder compartment 318.

Figure 20:
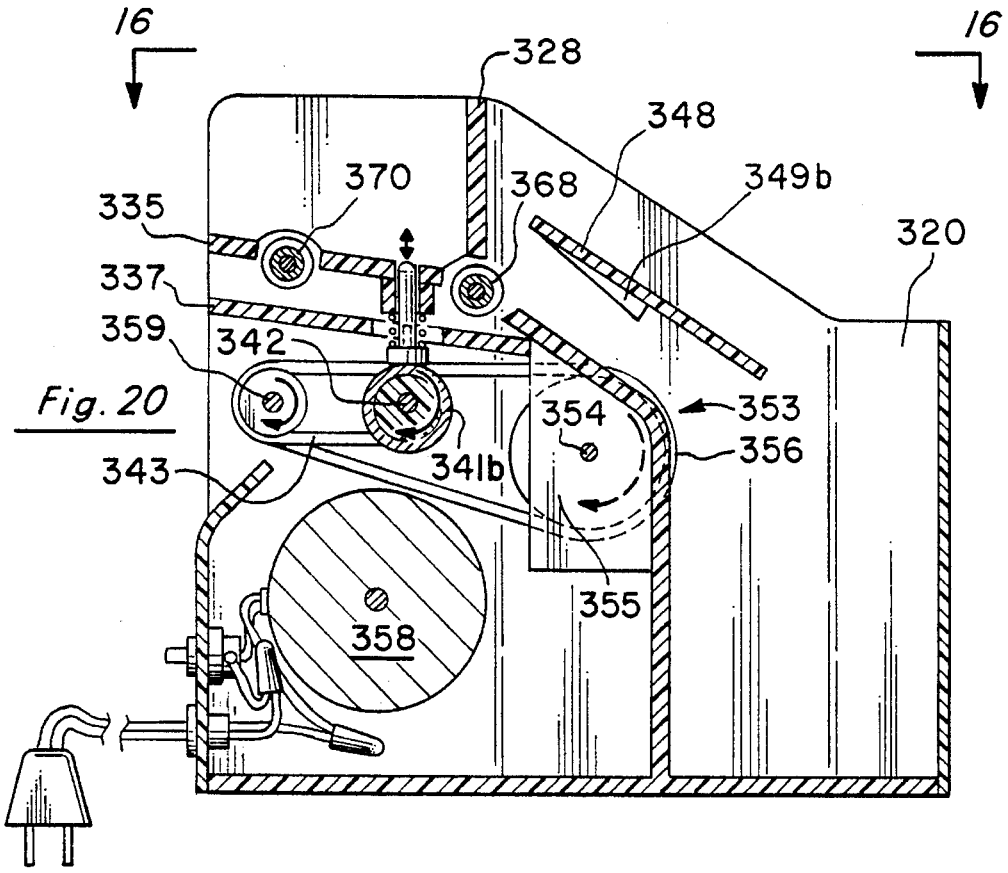
FIG. 20 illustrates an optional deflector bar feature in accordance with the present invention.

Spindle 342 can be driven in any convenient manner either by a direct motor (not shown), or by a gear or belt-driven arrangement as shown in FIG. 20. The belt-driven arrangement offers the advantage of allowing a single motor 358 to control the entire card shuffler 310. However, a direct drive arrangement with a stepper motor controlling cam spindle 341 could provide computer control of interruption mechanism 336 and perhaps better pseudo-random performance. Alternatively, cams 341*a* and 341*b* could be mounted on separately rotatable spindles (not shown) to allow independent action of the cams and plungers. Another equivalent approach would eliminate the use of cams and use separate solenoids or the like to be systematically activated to interrupt delivery of card "c".

In one example, plungers 339*a* and 339*b* are fabricated from a polyurethane tube. One end of the polyurethane tube is passed through a mounting bracket 334 to hold it in vertical alignment and allow it to move up and down following the action of cams 341*a* and 341*b*.

It should be appreciated that a great variety of materials and structures can be used to implement pseudo-random structure in accordance with the present invention. For example, the slots allowing cards to exit the feeder chamber could be blocked momentarily. Similarly, the drive rollers could be made to disengage the card momentarily. All of these various and equivalent approaches function to provide an interrupter that momentarily prevents ejection of at least one card in one of the stacks either randomly or according to a pattern such as a pseudo-random pattern. These and other implementations are within the spirit and scope of the present invention.

Deflector Bars in the Deflector Structure

The prior embodiment uses a deflector structure 22 having a deflector panel 48 that deflects the cards exiting feeder compartment 18. It has been found that improved performance is achieved when one or more deflector bars 349 extend from the inner surface of a modified deflector panel 348. Deflector bars 349*a* and 349*b* provide deflecting surfaces that replace the planar deflecting surface of deflector panel 48 in the previous embodiment.

Deflector panel 348 is moved upward with respect to deflector panel 48 of shuffler apparatus 10 as seen by comparing FIG. 2 with FIG. 15. The lower surfaces 350*a* and 350*b* of deflector bars 349*a* and 349*b* are in substantially the same vertical position as was deflector panel 48 in card shuffler 10. Deflector bars 349*a* and 349*b* serve to deflect the cards exiting feeder compartment 318 rather than deflector panel 348 in the card shuffler apparatus 310.

Figure 18:
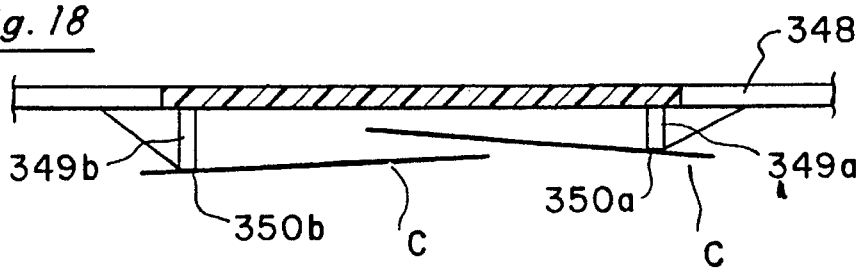
FIG. 18 shows a top view of the improvement of the card shuffler apparatus.

As seen in FIG. 18, deflector bars 349*a* and 349*b* allow cards "c" exiting feeder compartment 318 to flutter or rotate somewhat while in deflector structure 322. This fluttering action allows the cards leaving either side of feeder compartment 318 at the same time to mix or interleave more reliably. Although one deflector bar may be used, it is preferable to use two deflector bars 349*a* and 349*b* as shown in FIG. 18. This allows both exiting cards to flutter. When more than one deflector bar is used, it is desirable that each of deflector bars 349*a* and 349*b* have a different height or extension from the inner surface of deflector panel 348 as shown in FIG. 18. This allows simultaneously exiting cards to pass through the deflector structure 322 at different vertical heights and thus interleave better.

Deflector bars 349*a* and 349*b* may be mounted in any position on deflector panel 348. By mounting deflector bars 349*a* and 349*b* near an edge or the center part of deflector panel 348, greater flutter is imparted on the exiting cards. It is contemplated that first and second deflector bars 349*a* and 349*b* can be positioned on opposite sides of deflector panel 348 near the edges and that a third deflector bar (not shown) can be mounted in a central portion of deflector panel 348, thereby affording great control of the amount of flutter and vertical position of cards as they pass through deflector structure 322.

As shown in FIG. 15, deflectors 349 are wedge-shaped in the preferred embodiment. It is to be understood that any suitable structural shape that achieves the desired fluttering could be used. For example, the deflector panel 348 could be molded to have deflector ridges and valleys in accordance with the teachings of the present invention.

Lazy Card Ejector

It has been found that as cards pass through deflector structure 22 of card shuffler apparatus 10 a small minority may be momentarily delayed on deflector floor panel 52. These cards are referred to herein as "lazy cards." Lazy cards result because the momentum of each card leaving feeder compartment 18 varies somewhat and some cards may have insufficient momentum to fully clear the length of deflector structure 22. This is because cards may be plastic or paper, and vary greatly in stiffness and surface friction, which affect the ability of card shuffler apparatus 10 to handle them. These factors are aggravated as the cards age and are handled by players. To reflect a manual shuffle most accurately, it is desirable to remove these cards from the upper surface of deflector floor panel 52 as quickly as possible.

To achieve this goal, an improved embodiment of the present invention includes a lazy card ejector 353 (shown in FIG. 15) for engaging cards that rest on the surface of deflector floor panel 352 and moving them forward into receiver compartment 320. This feature of the present invention (best seen in FIG. 20) is achieved in a particular embodiment using a spindle 354 with a wheel or pulley 355 mounted in a position underneath deflector floor panel 352. One or more slots 357 are cut in the surface of deflector floor panel 352. Wheel 355 is mounted on spindle 354 and sized so that a peripheral portion passes through each slot 357 in deflector floor panel 352. A frictional surface is placed on the peripheral surface of each wheel 355. Spindle 354 is driven so as to rotate in a direction that will engage any cards on deflector floor panel 352 and move them into receiver compartment 320, as suggested by the arrow in FIG. 20.

A convenient drive mechanism is illustrated in FIG. 15 and FIG. 20. A drive spindle 359 is mounted in any convenient location underneath feeder compartment 318 or deflector structure 322. Drive spindle 359 is coupled to motor 358 by timing belt 377 (shown in FIG. 15).

A drive belt 356 formed by an O-ring couples drive spindle 359 to spindle 354. In a preferred embodiment, the O-ring wraps around the wheel or pulley 355 so that the O-ring itself forms the frictional surface used to move cards on deflector floor 352.

It should be apparent that any number of drive mechanisms and mechanical arrangements may be used to frictionally engage lazy cards on deflector floor 352 and move them into receiving chamber 320. One or more wheels 355 may be used. A drive belt may be coupled directly to spindle 354 rather than wheel 355. Also, non-frictional designs could be used. For example, opening 357 could be circular and a short burst of air could be provided to through the opening to move any cards from deflector floor panel 352 to receiving compartment 320. Operation of the lazy card ejector is desirably continuous, but may be periodic, or occur only after a shuffle. These alterations and embodiments of the present invention are within the spirit and scope of the inventive concept.

Fence Edge Design

As shown in FIG. 15 the lower edge of fence 328 can be tailored to have first and second heights. The junction between roller 368 (shown in FIG. 20) and fence 328 creates a space or slot 329*a* allowing cards to pass from feed chamber 318 into deflector structure 322. The improved fence design shown in FIG. 15 creates a slot 329*a*–329*b* having first and second heights. The first portion 329*a* of the slot formed by roller 368 and an edge portion of fence 328 provides a narrow slot 329*a* allowing roller 368 to frictionally engage one or more cards to eject them from feeder compartment 318 into deflector structure 322. A second portion has a larger slot 329*b* allowing an edge of each card to fly upward imparting a rotational momentum (illustrated by the rotation of cards "c" in FIG. 18) on the card as it exits card feeder compartment 318. The rotational momentum carries through into deflector structure 322 creating a flutter in the cards and improving interleaving of the cards as they mix in deflector structure 322.

The first portion of the slot 329*a* defined by roller 368 and the lower edge of fence 328 should be sized to allow a fixed number of cards (i.e., one to five cards) to pass through. The height of second portion 329*b* is not critical so long as it allows some rotation of the cards. The size of the raised portion can be varied greatly depending on the amount of flutter desired. The flutter imparted by the second portion 329*b* will interact with deflector bars 349*a* and 349*b* described hereinbefore to provide a desired degree of flutter and interleaving in deflector chamber 322.

Drive Mechanism

Figure 19:
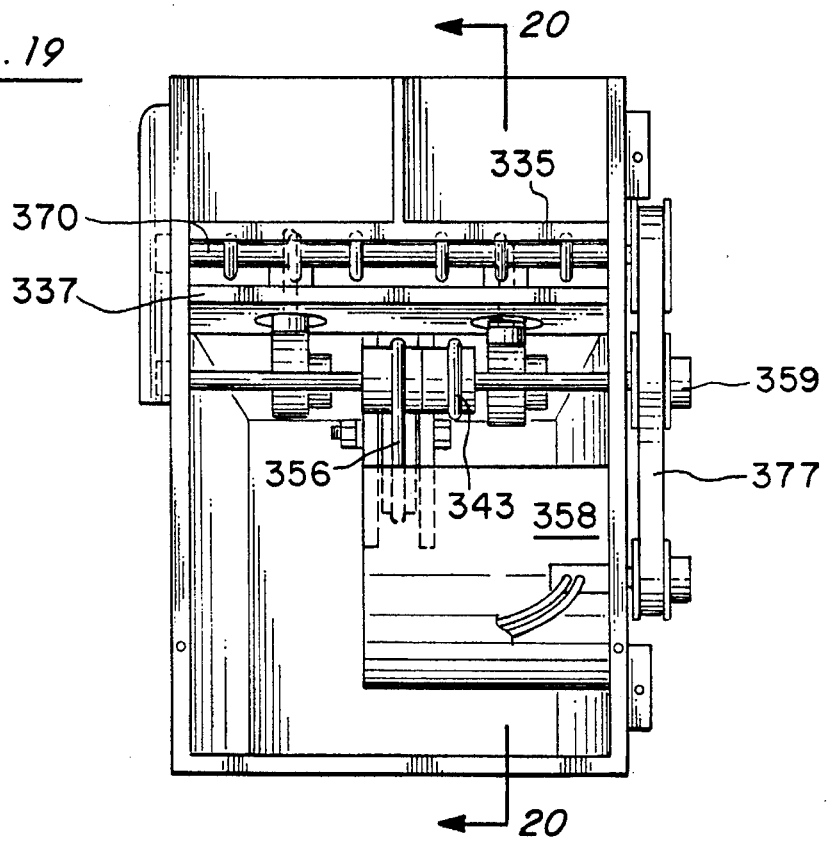
FIG. 19 illustrates an enlarged cross-sectional view of a pseudo-random mechanism in accordance with the present invention.

FIG. 15, FIG. 19, and FIG. 20 together illustrate a preferred drive mechanism in accordance with the present invention. Desirably, a single motor 358 is used to drive all moving components of shuffler apparatus 310. Motor 358 is illustrated as an AC motor, but a DC motor is acceptable and desirable in some instances. Power may be supplied by an AC main, or by an onboard power supply or battery (not shown).

Timing belt 377 couples motor 358 to spindle 359 and rollers 368 and 370 as shown in FIG. 15. As seen in FIG. 20, spindle 359 preferably drives both wheel 355 of lazy card ejector mechanism 353 and cam spindle 342 of pseudo-random mechanism 336. O-rings are acceptable components for drive belt 343 and drive belt 356. The vertical spacings shown in FIG. 19 are illustrative only, and other spacings may be used to accommodate the demands of a particular application. More than one motor may be used to allow independent action and control of the various components of the present invention.

It is to be expressly understood that the claimed invention is not to be limited to the description of the preferred embodiment but encompasses other modifications and alterations within the scope and spirit of the inventive concept.

I claim:

1. A card shuffler apparatus, comprising:

a card feeder compartment for receiving a plurality of stacks of unshuffled cards;

a card receiver compartment sized to accommodate a single stack of shuffled cards;

a deflector structure between and in communication with the card feeder compartment and the card receiver compartment, the deflector structure including an upper deflector panel;

a first deflector extending from an inner surface of the deflector panel and positioned to deflect cards moving from the card feeder compartment as they pass through the deflector structure;

a second deflector extending from the inner surface of the deflector panel and positioned to deflect cards moving from the card feeder compartment as they pass through the deflector structure; and a card ejector mechanism associated with the card feeder compartment and operative to eject at least a single card in each stack of unshuffled cards disposed in the card feeder compartment into the deflector structure so that ejected ones of the cards strike the first deflector and deflect into and descend in the card receiver compartment to accumulate therein, thereby forming the single stack of shuffled cards.

2. The card shuffler apparatus of claim 1 wherein the first deflector is positioned to deflect ejected ones of a first of the plurality of stacks of unshuffled cards and the second deflector is positioned to deflect ejected ones of a second of the plurality of stacks of unshuffled cards.

3. The card shuffler apparatus of claim 1 wherein the first deflector extends away from the inner surface a greater distance than the second deflector extends from the inner surface.

4. The card shuffler apparatus of claim 1 wherein the first deflector is positioned at a predetermined distance from the card feeder compartment so that a downward force placed on the leading edge of the ejected card as the leading edge strikes the deflector increases pressure between a mid-portion of the ejected card and the card ejector mechanism.

5. A card shuffler apparatus comprising:

a card feeder compartment for receiving a plurality of stacks of unshuffled cards;

a card receiver compartment sized to accommodate a single stack of shuffled cards;

a deflector structure between and in communication with the card feeder compartment and the card receiver compartment, the deflector structure including a pair of converging sidewalls, an upper deflector panel, and a lower deflector panel;

a card ejector mechanism associated with the card feeder compartment and operative to eject at least a single card in each stack of unshuffled cards disposed in the card feeder compartment into the deflector structure so that ejected ones of the cards strike a first deflector and deflect into and descend in the card receiver compartment to accumulate therein, thereby forming the single stack of shuffled cards, the card ejector mechanism comprising:

a lazy card ejector operative with the lower deflector panel for moving the cards into the receiver compartment.

6. A card shuffler apparatus, comprising:

a card feeder compartment for receiving a plurality of stacks of unshuffled cards;

a card receiver compartment sized to accommodate a single stack of shuffled cards;

a deflector structure between and in communication with the card feeder compartment and the card receiver compartment;

a card ejector mechanism engaging at least one card at the bottom of each of the stacks of unshuffled cards, the card ejector mechanism being operative to eject the at least one card in each stack of unshuffled cards disposed in the card feeder compartment into the card receiver compartment;

an interrupter coupled with the card feeder compartment for momentarily preventing ejection of at least one card of the stacks of unshuffled cards; and a spindle;

a spindle drive operative to impart rotational movement to the spindle;

at least one cam mounted on the spindle underneath one of the at least one stack of unshuffled cards; and a plunger having a first end interacting with the cam surface and a second end extending into the card feeder compartment to engage the at least one card when the cam is in a first position, wherein the second end retreats out of the card feeder compartment when the cam is in a second position.

7. The card shuffler apparatus of claim 6 wherein the means for momentarily interrupting serves to alternatively interrupt the at least one card in each of the stacks of unshuffled cards.

* * * * *